US012134413B2

(12) United States Patent
Bartek et al.

(10) Patent No.: US 12,134,413 B2
(45) **Date of Patent: *Nov. 5, 2024**

(54) DERAILMENT MITIGATION DEVICE FOR RAILROADS AND RAIL TRACKS

(71) Applicant: PB Innovations, LLC, Ledgewood, NJ (US)

(72) Inventors: Peter M. Bartek, Ledgewood, NJ (US); Michael S. Davis, Westminster, MD (US)

(73) Assignee: PB Innovations, LLC, Ledgewood, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/539,863

(22) Filed: Dec. 14, 2023

(65) Prior Publication Data

US 2024/0166248 A1 May 23, 2024

Related U.S. Application Data

(63) Continuation of application No. 18/204,102, filed on May 31, 2023, now Pat. No. 11,891,096.

(60) Provisional application No. 63/475,472, filed on Nov. 14, 2022, provisional application No. 63/475,026, filed on Oct. 11, 2022, provisional application No. 63/474,883, filed on Sep. 26, 2022, provisional application No. 63/474,888, filed on Sep. 26, 2022, provisional application No. 63/473,439, filed on May 31, 2022.

(51) Int. Cl.
*B61F 9/00* (2006.01)
*B61K 9/08* (2006.01)

(52) U.S. Cl.
CPC ..... *B61F 9/005* (2013.01); *B61K 9/08* (2013.01)

(58) Field of Classification Search
CPC .... G01M 5/00; G01M 5/0025; G01M 5/0058; G01M 5/005; G01M 5/0066; G01M 5/0075; G01M 5/0041; E01B 35/06; E01B 35/08; E01B 35/10; E01B 35/12; B61L 23/047; B61L 23/002; B61L 23/007; B61L 2205/00; B61L 2205/04; B61L 2205/02; B61L 1/02; B61L 1/06; G01B 5/14
See application file for complete search history.

(56) References Cited

U.S. PATENT DOCUMENTS 5,493,812 A 2/1996 Teich
10,713,916 B1 7/2020 Cole Thomas
(Continued)

FOREIGN PATENT DOCUMENTS

CN 202705833 U 1/2013
DE 202005000956 U1 6/2005

*Primary Examiner* — John Fitzgerald
*Assistant Examiner* — Truong D Phan
(74) *Attorney, Agent, or Firm* — Banner & Witcoff, Ltd.

(57) ABSTRACT

A portable, single-fixation, magnetic derailment mitigation device may be fixed on a rail track for measuring the deflection of the rail track. The magnetically fixing device is used for measuring vertical track deflection (sleeper voids), horizontal track deflection, ambient and rail temperature, rail angle, vibration, displacement, and location. The derailment mitigation device sends digital notifications and/or alarms during the live train and/or freight operations to help prevent derailments, rail buckles, breaks, and pull apart. The measured data and/or all events obtained from the derailment mitigation device is stored in the data storage such as cloud storage and viewed from any smart devices.

20 Claims, 30 Drawing Sheets

(56) References Cited

U.S. PATENT DOCUMENTS

| | | | |
|---|---|---|---|
| 2008/0304065 | A1 | 12/2008 | Hesser et al. |
| 2016/0107664 | A1 | 4/2016 | Kull |
| 2018/0327010 | A1 | 11/2018 | Kernwein et al. |
| 2020/0070857 | A1 | 3/2020 | Bartek et al. |
| 2020/0158656 | A1 | 5/2020 | Chung et al. |
| 2020/0262457 | A1 | 8/2020 | Bartek et al. |

DERAILMENT MITIGATION DEVICE FOR RAILROADS AND RAIL TRACKS

CROSS-REFERENCE TO RELATED APPLICATIONS

This application claims priority to U.S. patent application Ser. No. 18/204,102, filed May 31, 2023, which claims priority to U.S. Provisional Application No. 63/473,439, filed May 31, 2022; U.S. Provisional Application No. 63/474,883, filed Sep. 26, 2022; U.S. Provisional Application No. 63/474,888, filed Sep. 26, 2022; U.S. Provisional Application No. 63/475,026, filed Oct. 11, 2022; and U.S. Provisional Application No. 63/475,472, filed Nov. 14, 2022, all of which are herein incorporated by reference in their entirety.

TECHNICAL FIELD

The present invention pertains generally to rail track measurement and more particularly, to a portable, dual-laser derailment mitigation device that measures the vertical rail displacement (sleeper void), horizontal rail displacement, and/or deflection of a rail track.

DESCRIPTION OF THE RELATED ART

In the railway road industry, rail tracks typically comprise of a set of parallel tracks where railroad cars or train or any other suitable vehicles would run. Generally, the rail track consists of steel rails engaged on crossties or ties to keep the rails at the correct gage i.e., maintain the distance apart and used for supporting the weight of trains.

The rail tracks are set in various, different areas including remote areas as rail is one of the major modes of transportation used. In any event (or adverse situation), these rail tracks can be moved as a result of surface subsidence and/or damaged from storms or other natural occurrences, such as earthquake or floods. Assessing the condition of those damaged rail tracks might not occur as it may be a remote location or there might be no knowledge of an incident occurrence. The displacement or shift in the rail track can be caused by shifting ties and/or the displacement of material. Also, there are instances, where rail tracks are shifted or washed away resulting in the ties and hence the rail tracks shifting the position. Damaged, moved, or shifted rail tracks can lead to dangerous situations and potential derailments.

Further, the temperature influence during buckling of rails also causes changes in the horizontal and vertical track alignment. The rail tracks can also experience a displacement due to a man-made accident, for example, a barge hitting a pillar, excessive pumping ties, cement ties. With respect to those damages and to identify and rectify the damages, visual inspections may be the best option. During the visual inspections, it is possible that existing or pending rail track shifting is yet to be identified as it mainly depends on the visible damage further the damages might occur at different routine and timing of the inspections.

Further, the method of routine track maintenance may be used for locating such damages by comparing initial track data with subsequent data. These differences can indicate anomalies of damages for thorough investigations. Track-side measuring devices used today are done individually. Most independent system are done individually as a mechanical device or individually as a monitoring device.

Usually, the conventional investigation techniques are employed to inspect the rail tracks and the rail tracks alignment. However, the conventional investigation techniques require intense labor and produce mixed results. Another investigation method is mobile multi-sensor systems that may be used to map the damage data based on the integration of digital imaging sensor results and precise navigation and investigation data. Other systems fail to address movement, vibrations, location and selection of navigation and antenna placement for reduction of data dropouts.

Moreover, the excessive vertical and horizontal rail displacement, excessive rail angle and extreme rail temperatures can increase risk of derailments, rail buckles, pull apart and rail breaks along with stopping train operation and or slower train speed operation. Adding a system on a train or a geometry car does not provide this information accurately. Trains and track geometry cars cannot provide push on rail. With only using a vehicle-mounted system, the operator will get the deflection the train sees and not the true deflection of the rail. Also, a vehicle-mounted system cannot capture each wheel set on a passenger or freight train and the data is static and not real time.

Hence, there is a need for portable track-side mounted rail measurement deflection device for accurately measuring the rail road and rail track characteristics such as horizontal rail deflection, vertical rail deflection (sleeper voids), distance, elevations, directions and angles that are especially important for construction layouts and surveys.

SUMMARY OF THE INVENTION

The present invention is generally a portable derailment mitigation device for measuring the deflection of a rail track. The device may be a magnetically fixing device and may be used for measuring vertical track deflection (sleeper voids), horizontal track deflection, ambient and rail temperature, rail angle, vibration, displacement, and location. The derailment mitigation device may send digital notifications and/or alarms during the live train and/or freight operations to help prevent derailments, rail buckles, breaks, and pull apart. The measured data and/or all events obtained from the derailment mitigation device may be stored in the data storage such as cloud storage and viewed from any smart devices.

According to one embodiment, a portable device that is fixed onto a rail track for measuring track deflection may comprise: an attaching mechanism for fixing the device onto the rail track; one or more lasers for measuring a vertical track deflection and a horizontal track deflection; a temperature sensing device for measuring a temperature of an ambient temperature and a rail temperature; an angle sensing device for measuring an angle of the rail track; a vibration sensing device for measuring vibration and displacement during a train movement on the rail track; and a location sensing device for determining a location of the device.

Further, the attaching mechanism for fixing the device may be a web-mounted magnetic fixation mechanism, that includes a magnet located in a magnetic reservoir within a recess on a fixing arm of the device. The magnet may include the temperature sensing device located opposite the magnet within the recess. The device may be attached to one side of a web of the rail track. The device may have an adjustable mechanism to adjust the device within a web of the rail track. The one or more lasers may measure to gage or a web of the rail track or an opposite running rail track. The angle of the rail track may be either in percentages or in inches. When in automatic mode, the vibration sensing device may be turned on when vibration is detected. Further, the vibration sensing device may be automatically turned off when there is no vibration is detected. The device may send a notification and an alert when one of the vertical track deflection, the horizontal track deflection, the ambient temperature, the rail temperature, or the angle of rail exceed preset alarm levels. The portable device may further include a data storage portion that stores data and events obtained from the device, wherein the data storage portion includes cloud storage that can be viewed from any smart device. The device may measure a super elevation. The device may include a solar panel for continuous power. The device may include an inclinometer. The device may include an axel sensor/counter that counts axels on a train passing over the device. The device may include an accelerometer. The attaching mechanism may include a telescopic handle with a handle portion, a lever portion, and a rail attachment portion for attaching the device to an upper rail of the rail track. The lever portion may actuate to lock and unlock the rail attachment portion to attach to and detach from the upper rail of the rail track.

In another embodiment, a portable derailment mitigation device that is fixed onto a rail track for measuring track deflection may comprising: a base that includes a control panel for controlling an operation of the portable derailment mitigation device; an attachment portion adjacent to the base that includes one or more attachment mechanisms for fixing the portable derailment mitigation device onto the rail track; and a laser portion that includes a first laser for measuring a horizontal track deflection and a second laser for measuring a vertical track deflection. The control panel may comprise: an angle sensing device for measuring an angle of the rail track, a temperature sensing device for measuring a temperature of an ambient temperature and a rail temperature, a location sensing device for determining a location of the portable derailment mitigation device, and a solar panel for providing continuous power to the portable derailment mitigation device.

Further, the portable derailment mitigation device may be attached to one side of a web of the rail track. The one or more attaching mechanisms for fixing the portable derailment mitigation device may be a magnetic fixation mechanism that includes one or more magnets located in a magnetic reservoir within a recess on the attachment portion. The temperature sensing device may be located opposite the one or more magnets within the recess. The portable derailment mitigation device may further include a vibration sensing device for measuring vibration and displacement during a train movement on the rail track. When in automatic mode and vibration is detected, the vibration sensing device may be turned on and the portable derailment mitigation device may start measuring. When there is no vibration detected, the vibration sensing device may be automatically turned off and the portable derailment mitigation device may stop measuring. The control panel may send a notification and an alert when one of the vertical track deflection, the horizontal track deflection, the ambient temperature, the rail temperature, or the angle of rail exceed preset alarm levels. The portable derailment mitigation device may include a data storage portion that stores data and events obtained from the portable derailment mitigation device, wherein the data storage portion includes cloud storage that can be viewed from any smart device. The portable derailment mitigation may include an axel sensor/counter that counts axels on a train passing over the portable derailment mitigation device. The attaching mechanism may include a telescopic handle with a handle portion, a lever portion, and a rail attachment portion for attaching the portable derailment mitigation device to an upper rail of the rail track. The lever portion may actuate to lock and unlock the rail attachment portion to attach to and detach from the upper rail of the rail track.

Other features and advantages of the invention will be apparent from the following specification taken in conjunction with the following drawings.

BRIEF DESCRIPTION OF DRAWINGS

The following Detailed Description will be better understood when considered in conjunction with the accompanying drawings in which like reference numerals refer to the same or similar elements in all of the various views in which that reference number appears.

DETAILED DESCRIPTION

Figure 1:
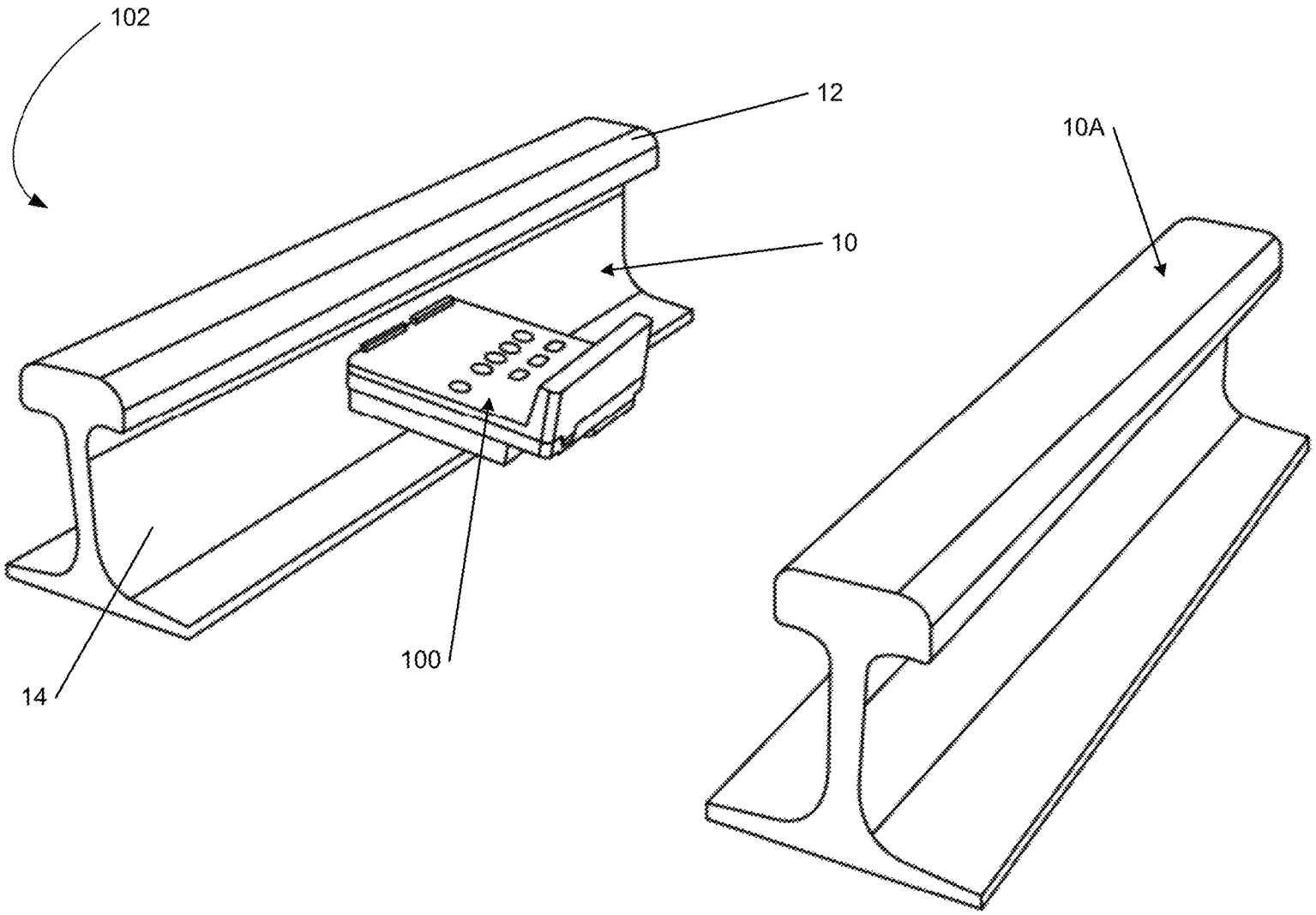
FIG. 1 depicts a side perspective view of a rail track with two rails and a derailment mitigation device attached to a webbing on one of the rail tracks, according to one or more aspects described herein.

In the following description of various examples of the invention, reference is made to the accompanying drawings, which form a part hereof, and in which are shown by way of illustration various example parts, structures, systems, and steps in which aspects of the invention may be practiced. It is to be understood that other specific arrangements of example parts, structures, systems, and steps may be utilized, and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures. Nothing in this specification should be construed as requiring a specific three-dimensional orientation of structures in order to fall within the scope of this invention.

This application and/or claims may use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

General Description

The present invention discloses a derailment mitigation device that is a portable, track-side single rail, magnetic, fixation deflection measurement device for rail angle measurement, super elevation measurement, ambient and rail temperature measurement, with a dual-laser for vertical rail displacement/measurement (sleeper voids), and/or horizontal rail displacement/measurement. The derailment mitigation device may send digital notifications about GPS location and alarms about the rail angle measurement, super elevation measurement, ambient and rail temperature measurement, vertical rail displacement/measurement (sleeper voids), and/or horizontal rail displacement/measurement.

According to present invention, the derailment mitigation device may be fixed onto the rail track for measuring track deflection, comprising: a) an attaching mechanism for fixing the device onto the rail track of measurement; b) one or more lasers for measuring the vertical and horizontal rail displacement; c) a temperature sensing device for measuring an ambient temperature and a rail temperature; d) a sensing device for measuring the angle of rail; e) a vibration sensing device for vibration and displacement during the train movement; and f) a location sensing device for determining the location.

In accordance with the present invention, the digital notifications on GPS location and alarms automatically turned on during live train or freight operation and automatically digitally sends data to the cloud and back end to an operations control center or smart device.

Furthermore, the device turns on automatically before train passes and turns off after train passes using a special vibration sensor. The operational control center may monitor and know if movements exceed safe operation, angles or temperatures and suspend or slow down service and allow maintenance crews to know the exact location and the details of the rail and track in regards to temp, angle, vertical and horizontal displacement.

Advantageously, the device of the present invention allows railways a simple way to magnetically place this device in different areas and see real time location and information during live rail traffic. The derailment mitigation device may provide digital notification, GPS locations, and alarms.

The derailment mitigation device may include one or more of the following features: magnetically attaches to one side of rail web; easy on and easy off installation; self-centering along the rail track; for all measurements, the derailment mitigation device does not need to physically span to the other rail; a first laser for horizontal track deflection measurement to any center rail or the other running rail; a second laser for vertical track deflection; a temperature sensor as part of the derailment mitigation device placed at the magnetic base; an angle sensor to determine angle in either percentages or inches; a vibration sensor for train detection that automatically turns the derailment mitigation device "ON" to measure displacement and deflection during train movement; vibration sensor turns the derailment mitigation device "OFF" automatically after the train passes and no vibration is detected; notifications and alerts when the vertical deflection, horizontal deflection, temperature, and/or angle exceed preset alarm levels; GPS to detect location of the derailment mitigation device; data storage of all events, notifications, and alarms; cloud based and can be viewed from any smart device; measures super elevation; solar-powered recharging and battery; allows a train to operate with full load and at full speed; cellular, Wi-Fi, and/or BLE communications with smart devices and/or cloud; rail alignment daisy chain and/or mesh from derailment mitigation device to derailment mitigation device; axel counter; sends mileage counter data wirelessly to train; telescopic handle; measures super elevation; measures gage face; measures railway cant (rate of change in elevation/height between the two rails or edges; cross level measurements, twist measurements, rail/opposite measurements, flangeway clearances, switchblade opening, back-to-back check rail; digital display, showing all measurements, such as gage, angle, elevation, or under in inches and mm and temperature in Celsius or Fahrenheit; automatically set to ⅝" on one side of gage then allows laser to find the other side of the rail gage.

The derailment mitigation device may be used as a direct fixation for ballast areas and/or high curve areas, high thermal stress areas, and for continuous welded rail (CWR) heat inspections. Special inspections using the derailment mitigation device of CWR areas may occur when the ambient temperature meets or exceeds the neutral temperature (PRLT) of the rail. Particular attention may be given to periods of temperature fluctuations. In the event daily cycles of extreme temperature fluctuations occur, consideration may be given to repeated inspections using the derailment mitigation device. Additionally, special attention using the derailment mitigation device may be paid to the surface at the rail joints, insulated joints, at bridge/tunnel approaches and between concrete and ties.

Embodiments of the derailment mitigation device may include an axel counter and a mileage counter device. Trains of different types normally use a time-based preventative maintenance program. The derailment mitigation device can provide a mileage-based system, that mounts to one side of the rail track and detects the approaching train via vibration and wheel counting sensors. The derailment mitigation device may then connect to the train counter via BLE, Wi-Fi, or Cellular and adds the additional miles that the train traveled in order to create preventative maintenance schedules.

Current track axel counting systems are fixed and require power to operate. The current track axel counting systems take days to install and are used to simply detect the number of axels that make up a train and gives an indication of when a train enters a section of track and exits a section of track. There is currently no track device that is portable and detects a train and axel and sends a wireless communication link to any train and adds the additional mileage the train has traveled.

The advantage of the axel counter with the derailment mitigation device is that it gives the railways a simple way to magnetically place the derailment mitigation device in fixed or different areas and connect to the train and add the additional mileage that the train traveled. When the train reaches a certain number of miles traveled, the axel counter can be used for preventative maintenance. The axel counter and derailment mitigation device turn on automatically before the train passes and turns off automatically after the train passes using a vibration sensor. The mileage-based axel counting train detector and communication to the train can use daisy chain or mesh from derailment mitigation device to derailment mitigation device with monitoring through GPS, Cellular, Wi-Fi, BLE, and charging and solar-powered. The advantage of the axel counter with the derailment mitigation device is that it moves the railways away from a time-based preventative maintenance system and now becomes a more effective, efficient, and accurate mileage preventative maintenance system.

Embodiments of the derailment mitigation device may include a telescopic handle and be a portable laser-based track gage, angle level, underbalanced, and super-elevation device with temperature sensing with GPS, Cellular, Wi-Fi, BLE and charging communication link from derailment mitigation device to smart phone and/or or to control center. The advantage of this derailment mitigation device with a telescopic handle is that it gives a faster, safer, and more accurate way of measurement using laser and sensor technology keeping the track worker out of the middle of the railroad tracks. With one simple step, the track inspector is off to the side of the tracks and can easily place the derailment mitigation device. The derailment mitigation device may include a telescopic handle on one of the rails and the derailment mitigation device measures and records in seconds the key measurements of track gage, cross level, twist, rail/opposite check rail, flangeway clearance, switchblade opening, back-to-back check rail, rail angle level, super elevation, and underbalanced with temperature sensing. The derailment mitigation device connects to any smart device and records the data in seconds and allows that data to be sent in real-time to a supervisor, or the operation control center. The derailment mitigation device may be placed portably on one of the running rails and then takes the measurements needed for both running rails.

Railway tracks require constant inspection and the measuring of gage, cross level, twist, rail/opposite checkrail, flangeway clearance, switchblade opening back-to-back check-rail and under-balanced condition where the high rail is lower than the lower rail. Currently, track inspectors use a track gage measurement tool which is a long pole like device that spans and has to touch mechanically both running rails. This prior art device has a level built-in along with a method using a dial know to increase one side or the other side of the device until the two running rails show a level area. The track inspector may then take a measuring tape and measure the level height to the top of the rail to gain how many inches or millimeters the rail on one side is super-elevated. The current method is very manual, requires the track inspect to be within the dynamic envelope of the tracks and center of the tracks and requires several measurement points to be taken. Embodiments of the derailment mitigation device according to this invention eliminates these requirements.

DETAILED DESCRIPTION

FIG. 1 illustrates a derailment mitigation device 100 in accordance with aspects of this invention. The derailment mitigation device 100 may attach to or connect to a rail track 10, and specifically a web 14 of the rail track 10. The derailment mitigation device 100 may attach to a first rail track 10 that is associated with a second opposite rail track 10A. The derailment mitigation device 100 may also attach to an upper rail 12 of the rail track 10.

FIGS. 2A-2D show the derailment mitigation device 100 and the self-centering on the web 14 of the rail track 10 and the magnetic attachment with a temperature sensor. The derailment mitigation device 100 may include a base 110 with an attachment portion 120 and a laser portion 130. The attachment portion 120 may include one or more attachment mechanisms for attaching the derailment mitigation device 100 to the rail track 10, such as magnets, clips, fasteners, etc. The laser portion 130 may include one or more lasers to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers may be utilized alone or in combination with various other sensors to determine the above measurements. The derailment mitigation device 100 may be self-centering on the rail track 10 and/or webbing 14 of the rail track 10 based on the magnetic fixation.

Figure 2B:
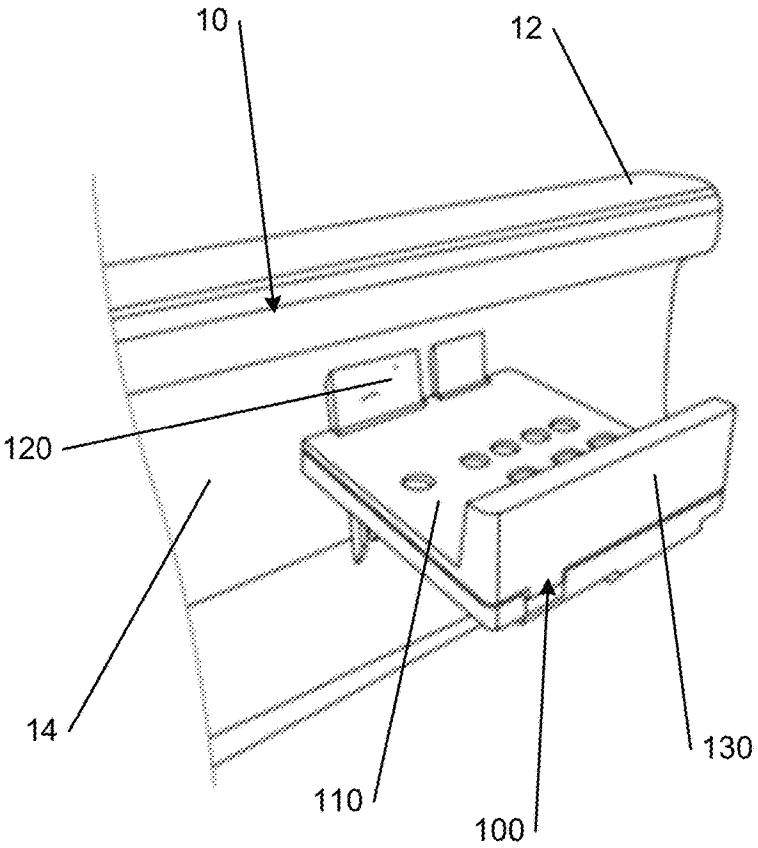
FIGS. 2A-2H depict various views of the derailment mitigation device from FIG. 1, according to one or more aspects described herein.
Figure 2A:
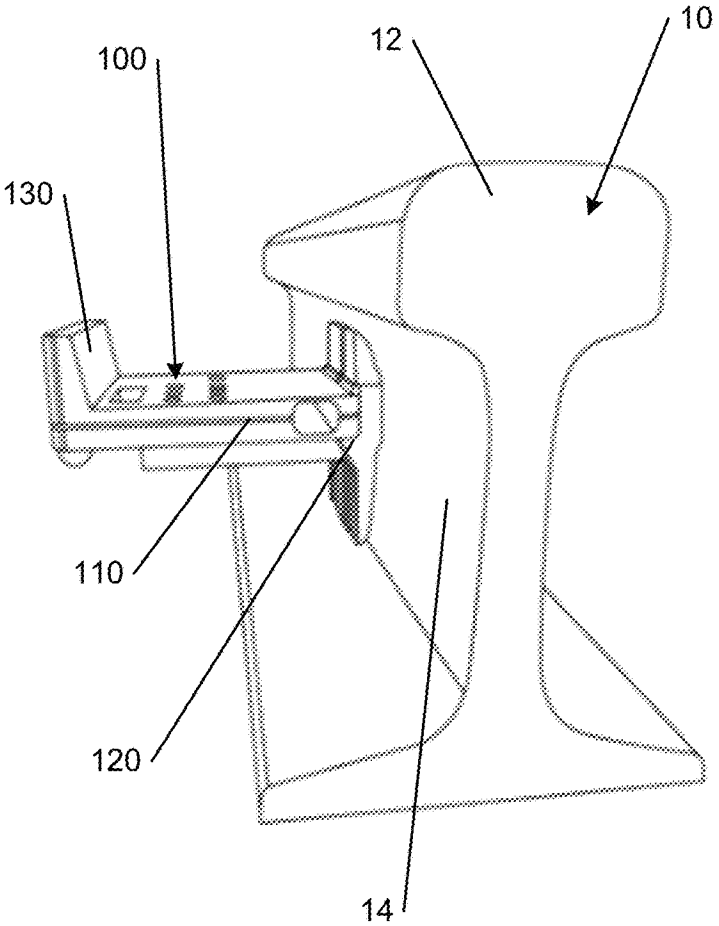
Figure 2D:
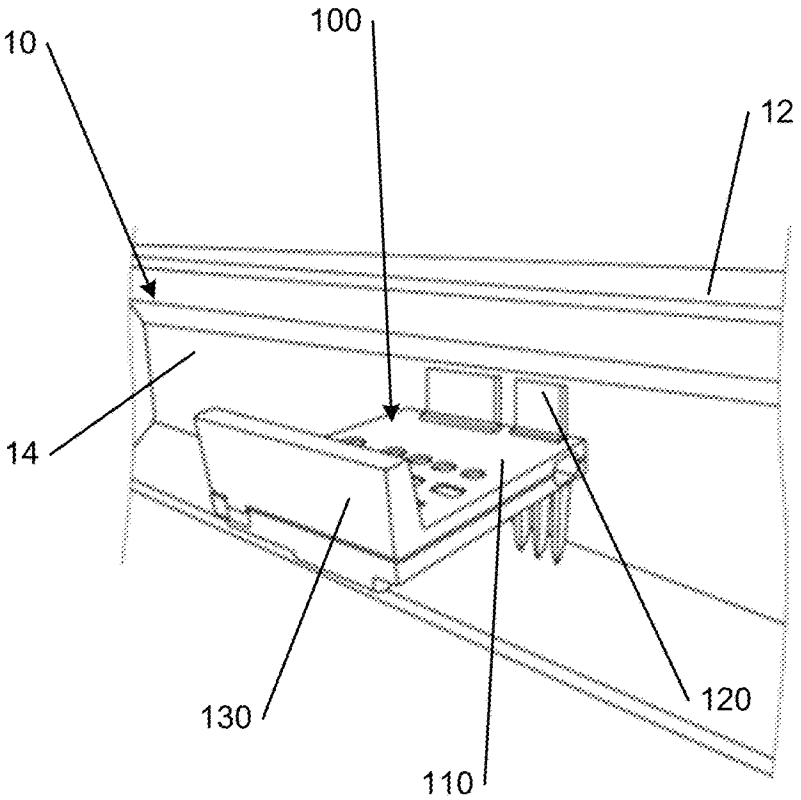
Figure 2C:
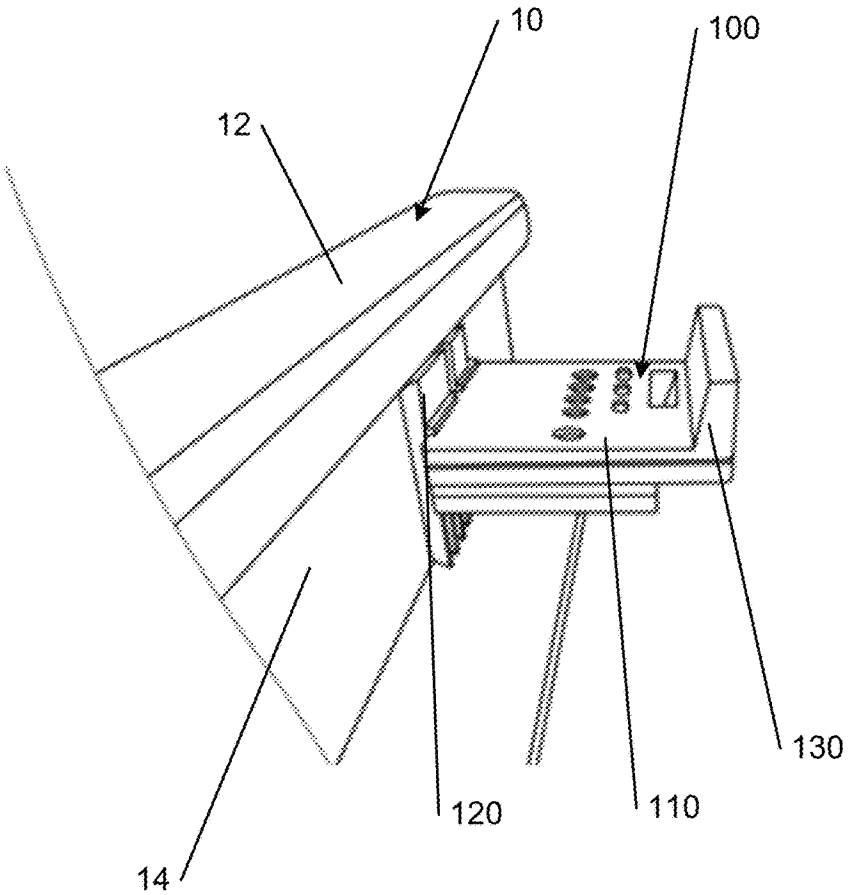
Figure 2E:
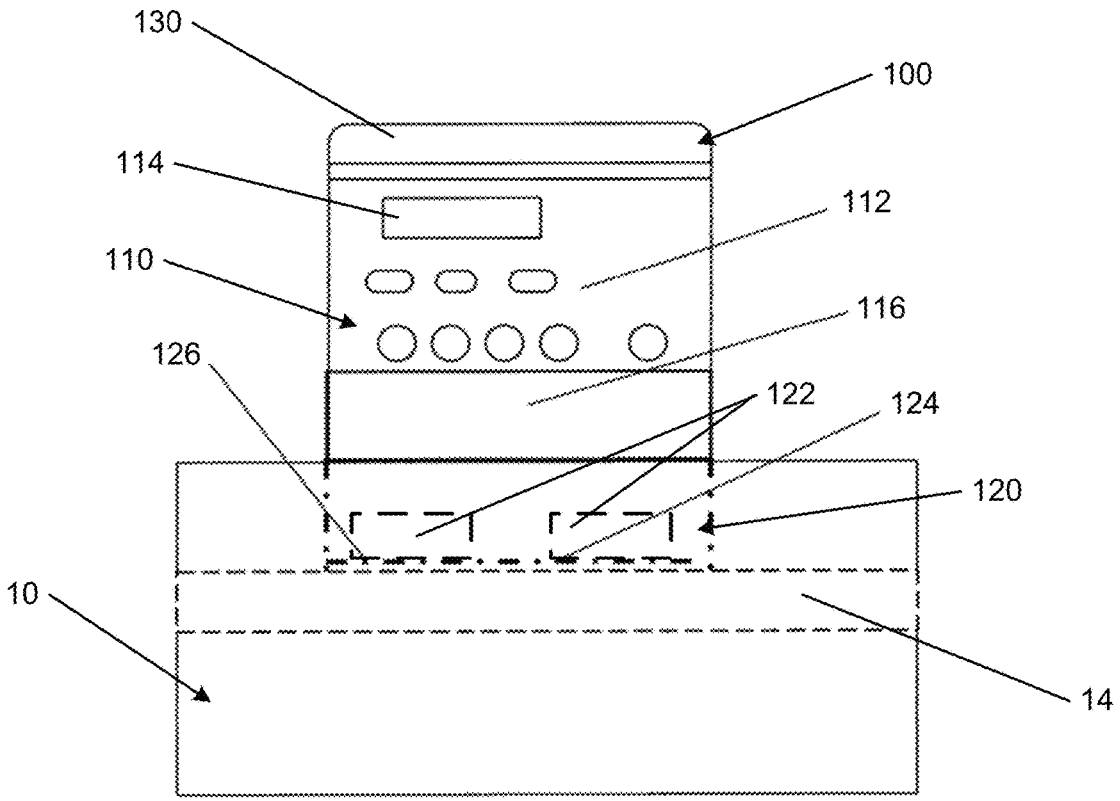
Figure 2F:
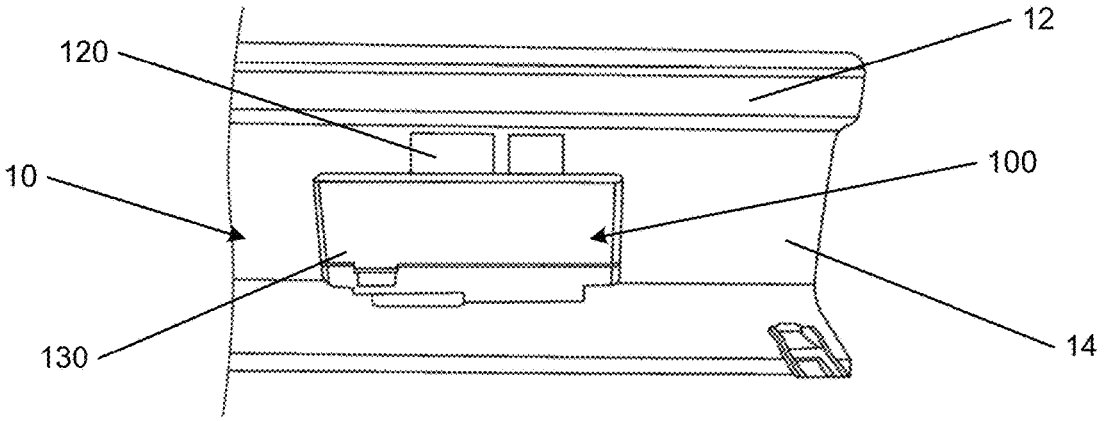

FIG. 2E shows a top cutaway view of the derailment mitigation device 100 illustrating specific components of each of the base 110, the attachment portion 120, and the laser portion 130. The base 110 may include a control panel 112 and a display panel 114. The derailment mitigation device 100 may include a full system display 114. As shown in FIG. 2H, the display panel 114 may display various real-time measurements and/or data, such as horizontal measurement ("H") 114A, vertical measurement ("V") 114B, angular measurement 114C, and temperature measurement ("T") 114D. Other real-time measurements and data may be shown on the display panel 114 without departing from this invention.

The control panel 112 may include buttons or switches for power and operating the derailment mitigation device 100. The control panel 112 may also include a solar panel 116 to power the derailment mitigation device 100. The control panel 112 may also house and hold one or more various other components that may be included with the derailment mitigation device 100, such as an inclinometer 170, a vibration sensor 172, a cellular/Wi-Fi controller 174, an axel sensor/counter 176, a mileage counter device 178, a GPS sensor 180, a temperature sensor 126, a tilt sensor 182, an accelerometer 184, a shock sensor 186, and/or a clock 188 (as shown in FIG. 14B). Additionally, in some embodiments, the base 110 may house one or more of the lasers as well.

Figure 2G:
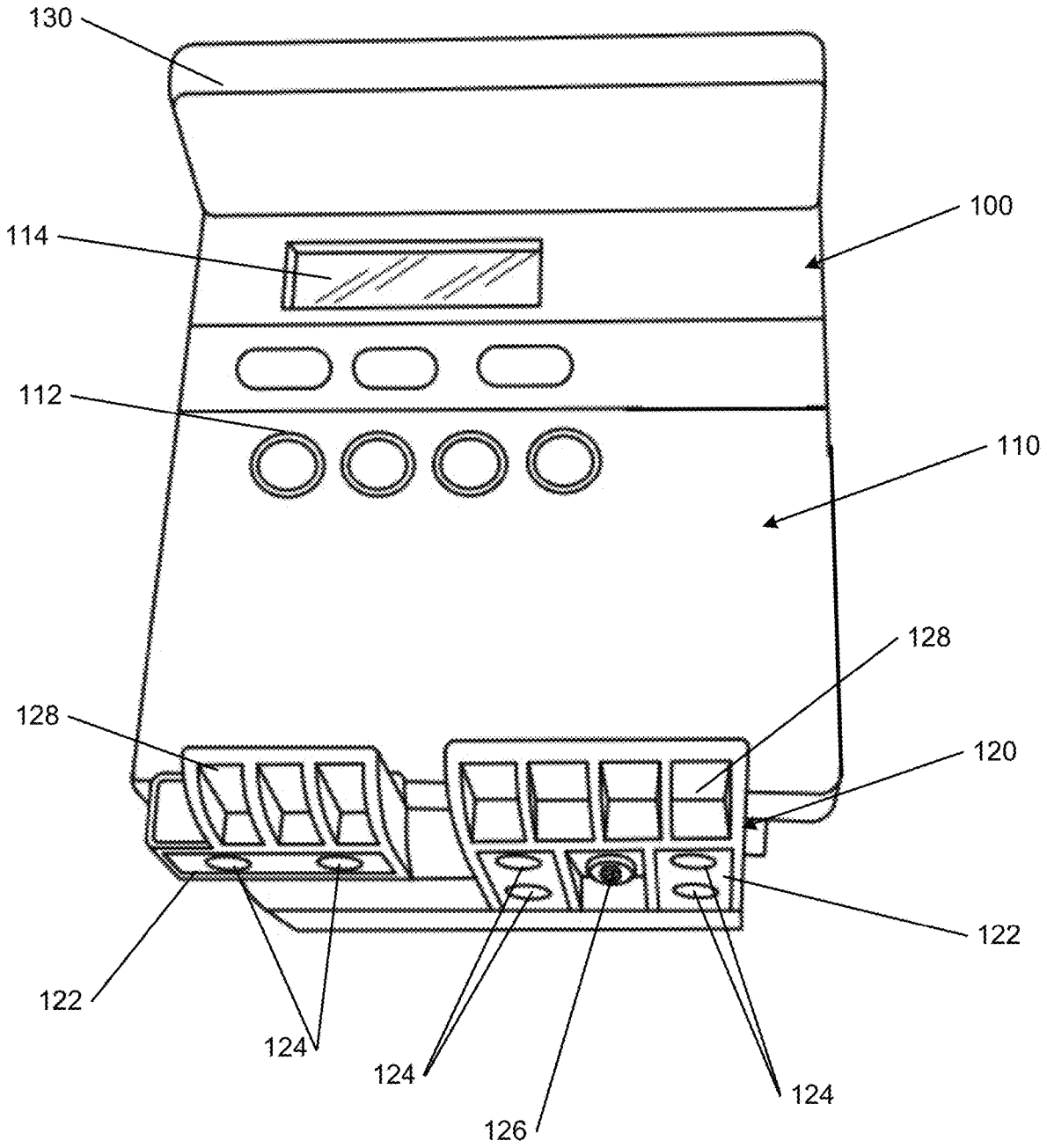
Figure 2H:
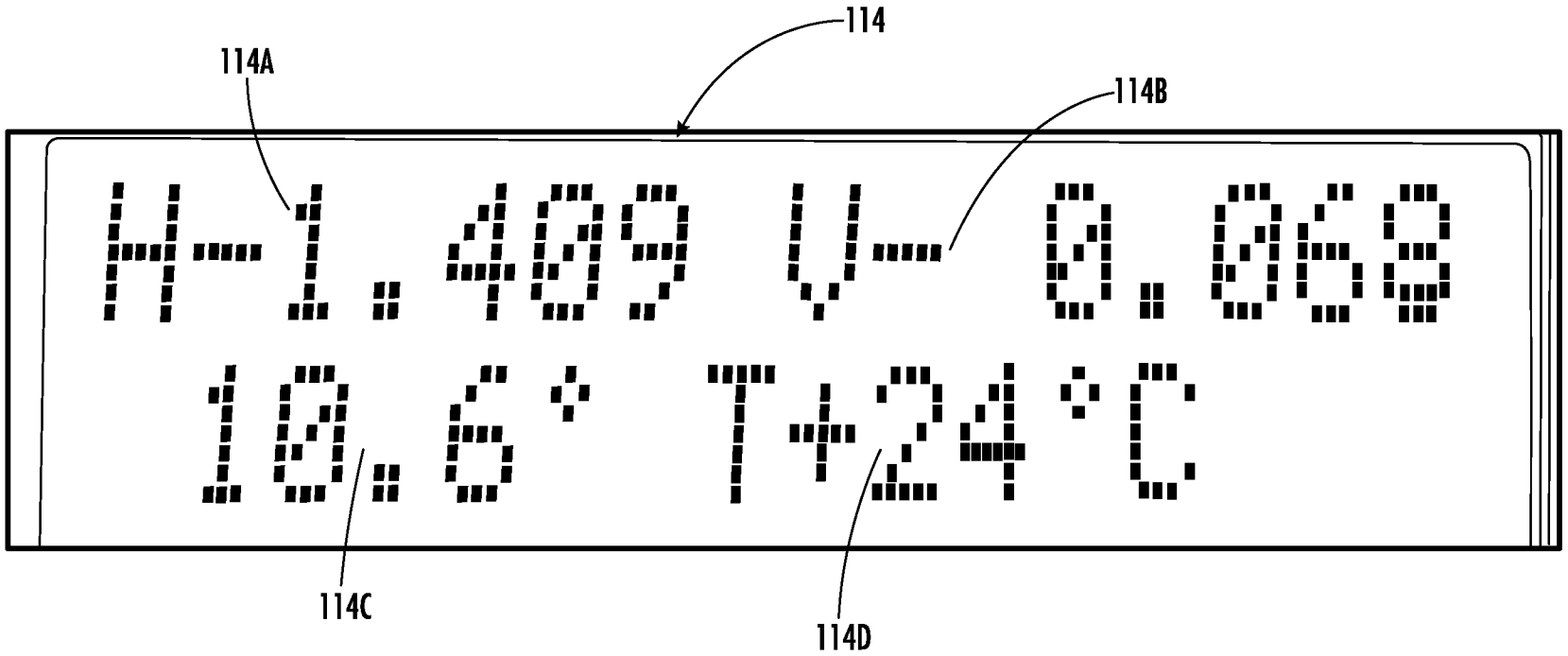

Additionally, as illustrated in FIGS. 2E and 2G, the derailment mitigation device 100 may include the attachment portion 120 that attaches the derailment mitigation device 100 to the web 14 of the rail track 10. The attachment portion 120 may include a web-mounted magnetic fixation mechanism. The attachment portion 120 may include one or more magnets 124 to attach the derailment mitigation device 100 to the web 14 of the rail track 10. In a preferred embodiment, the derailment mitigation device 100 may be magnetically fixed in on trackside as the derailment mitigation device 100 is web-mounted to the rail 10. The attachment portion 120 may include one or more recesses 122 for housing the one or magnets 124. The one or more recesses 122 may be magnetic reservoirs for the one or more magnets 124. The one or more recesses 122 and one or more magnets 124 may be rectangular. The one or more recesses 122 and one or more magnets 124 may be other shapes, such as circle, oval, or square, without departing from this invention. A temperature sensor 126 may be located on an opposite side of one or more of the magnets 124 within the magnet recess 122. A vibration sensor may also be located within the one or more recesses 122. The attachment portion 120 may also house and hold one or more various other components that may be included with the derailment mitigation device 100, such as the inclinometer 170, the vibration sensor 172, the cellular/Wi-Fi controller 174, the axel sensor/counter 176, the mileage counter device 178, the GPS sensor 180, the temperature sensor 126, the tilt sensor 182, the accelerometer 184, the shock sensor 186, and/or the clock 188. The attachment portion 120 may include a fixing arm 128 that provides a self-centering structure for the derailment mitigation device 100. The fixing arm 128 may help ensure that the derailment mitigation device 100 is centered and can be adjusted on the web 14 of the rail track 10. The attachment portion 120 may include an adjustable mechanism to adjust the derailment mitigation device 100 within the web 14 of the rail track 10.

FIG. 2F illustrates the web mount and clearance for the derailment mitigation device 100 on the rail track 10. For all measurements, the derailment mitigation device 100 does not need to physically span to the other opposite side rail 10A.

Figure 3A:
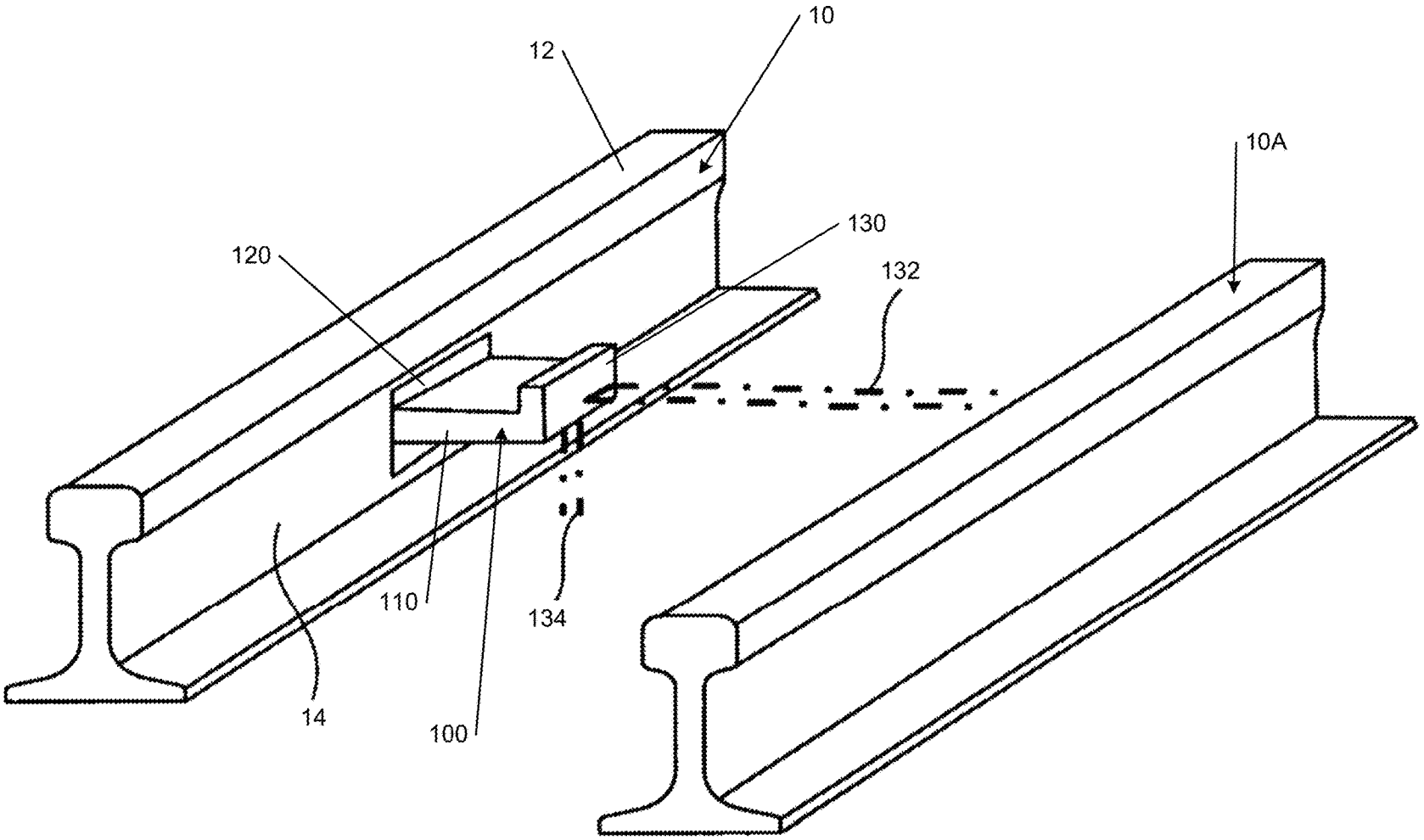
FIG. 3A depicts a side perspective view of the rail track and derailment mitigation device from FIG. 1 showing the lasers, according to one or more aspects described herein.
Figure 3B:
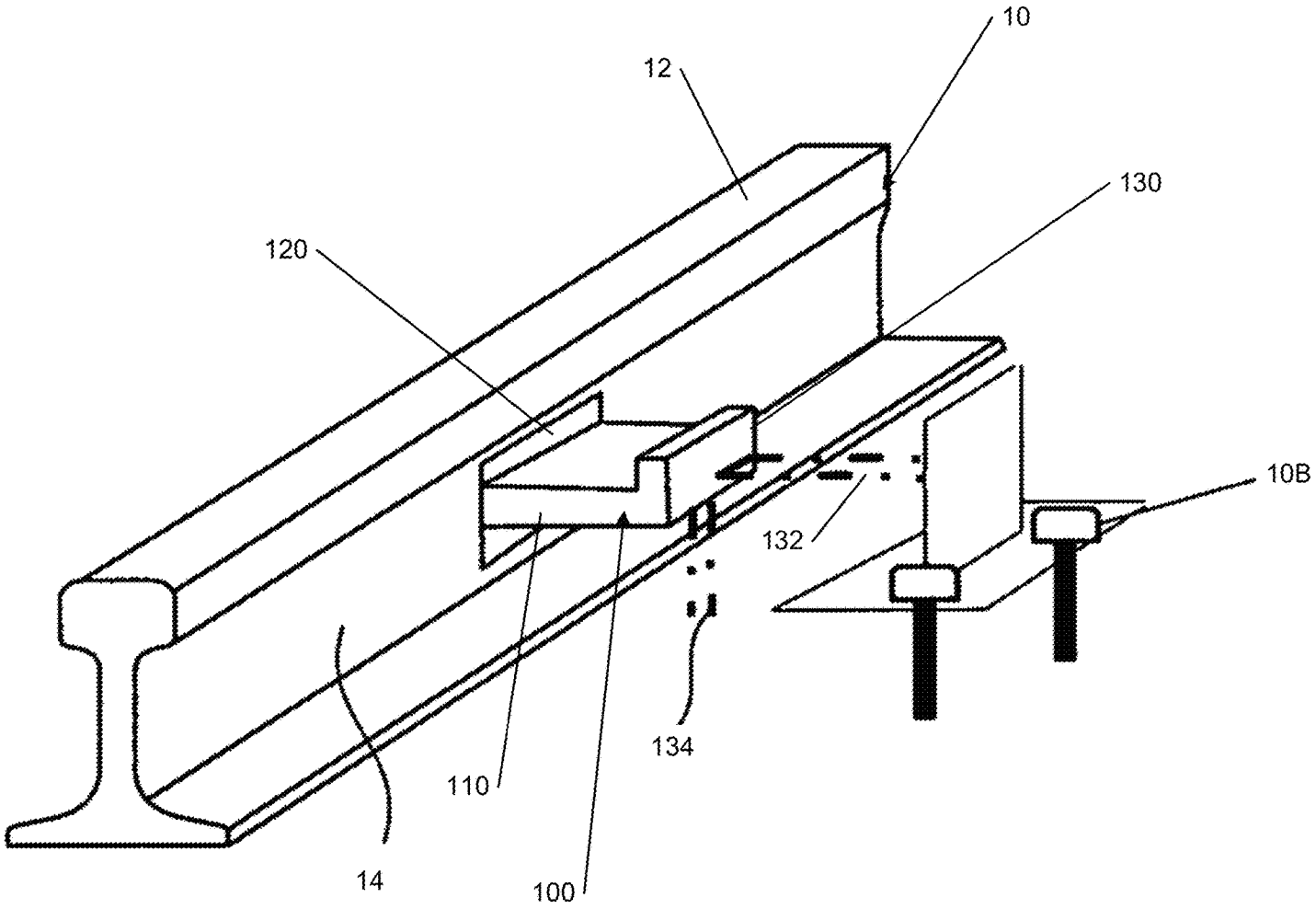
FIG. 3B depicts a side perspective view of the derailment mitigation device from FIG. 1 with a stationary/fixed point, according to one or more aspects described herein.

As illustrated in FIGS. 3A and 3B, the derailment mitigation device 100 may include a laser portion 130 that provides non-contact dual laser measurement with a first laser 132 and a second laser 134. The first laser 132 may be used for horizontal measurement or horizontal rail deflection to any center rail 10A or other running rail 10A. The second laser 134 may be used for vertical measurement or vertical rail deflection, also known as sleeper voids. FIG. 3A illustrates the derailment mitigation device 100 mounted on a single rail 10 showing the non-contact laser measurement to another opposite side rail 10A. FIG. 3B illustrates the derailment mitigation device 100 mounted on a single rail 10 showing the non-contact laser measurement and a fixed bracket 10B to gain rail adverse movement to alert excessive horizontal track deflection and movement. The laser portion 130 may also house and hold one or more various other components that may be included with the derailment mitigation device 100, such as the inclinometer 170, the vibration sensor 172, the cellular/Wi-Fi controller 174, the axel sensor/counter 176, the mileage counter device 178, the GPS sensor 180, the temperature sensor 126, the tilt sensor 182, the accelerometer 184, the shock sensor 186, and/or the clock 188.

Figure 4:
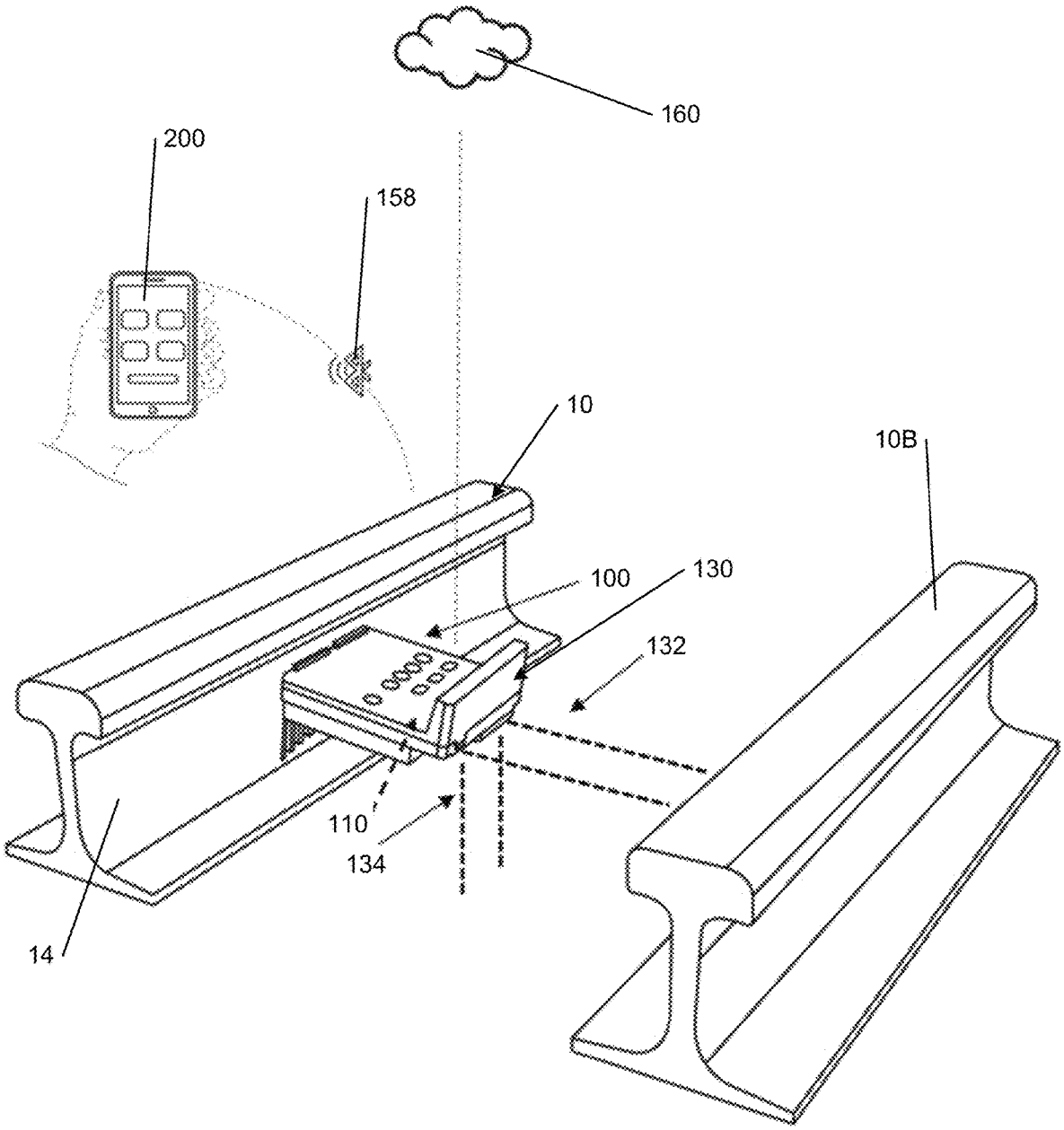
FIG. 4 depicts an exemplary communication link from the derailment mitigation device from FIG. 1, according to one or more aspects described herein.

FIG. 4 illustrates how the derailment mitigation device 100 may connect to any smart device 200. The smart device 200 may be any smart device, such as for example, a cellular phone, laptops, notebooks, smartphones, tablets, personal computers, servers, vehicles, home management devices, home security devices, smart appliances, etc. As illustrated in FIG. 4, the derailment mitigation device 100 may communicate with the smart device 200 and/or a network 160 or cloud using Bluetooth or the internet 158.

The derailment mitigation device 100 may get turned on automatically when the vibration sensor on the derailment mitigation device 100 detects vibration. The vibration may turn the derailment mitigation device 100 "ON" to measure displacement during the train movement over the derailment mitigation device 100. The derailment mitigation device 100 may turn off automatically after the train passes and no vibration is detected.

Figure 5B:
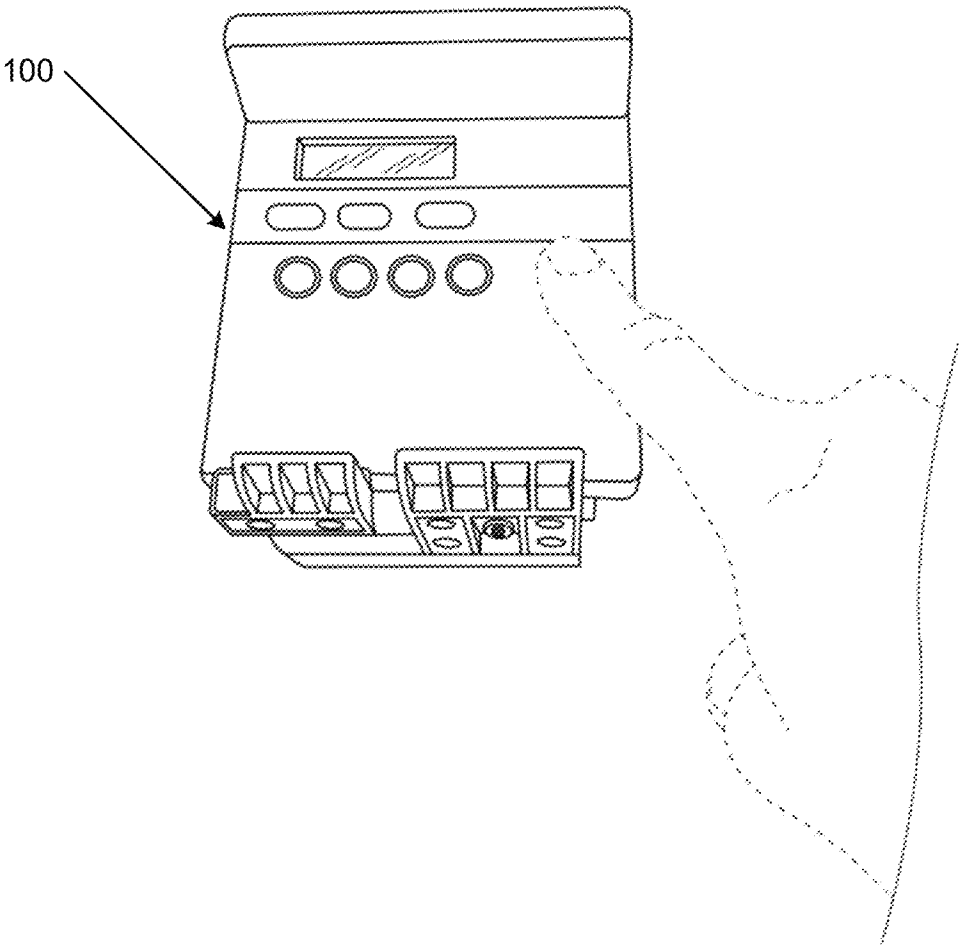
FIGS. 5A-5F depict steps for an exemplary functional operation for the derailment mitigation device from FIG. 1, according to one or more aspects described herein.
Figure 5A:
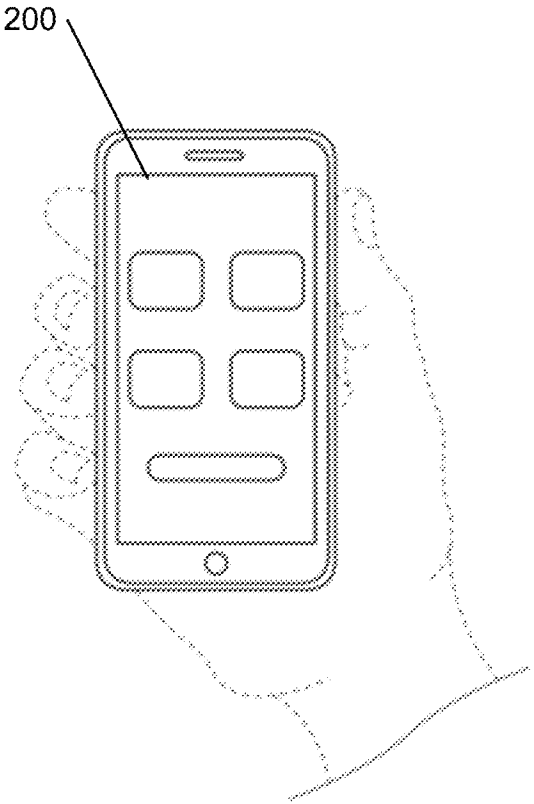

FIGS. 5A-5F illustrate an exemplary functional operation for the derailment mitigation device 100. As illustrated in FIG. 5A, the first step is to open an application on a smart device 200. FIG. 5B illustrates the track worker turning on the derailment mitigation device 100 by holding a power button for a certain period, such as for three seconds. After the application has been opened on the smart device 200 and the derailment mitigation device 100 has been powered on, the smart device 200 and the derailment mitigation device 100 will automatically connect to each within approximately five seconds.

Figure 5D:
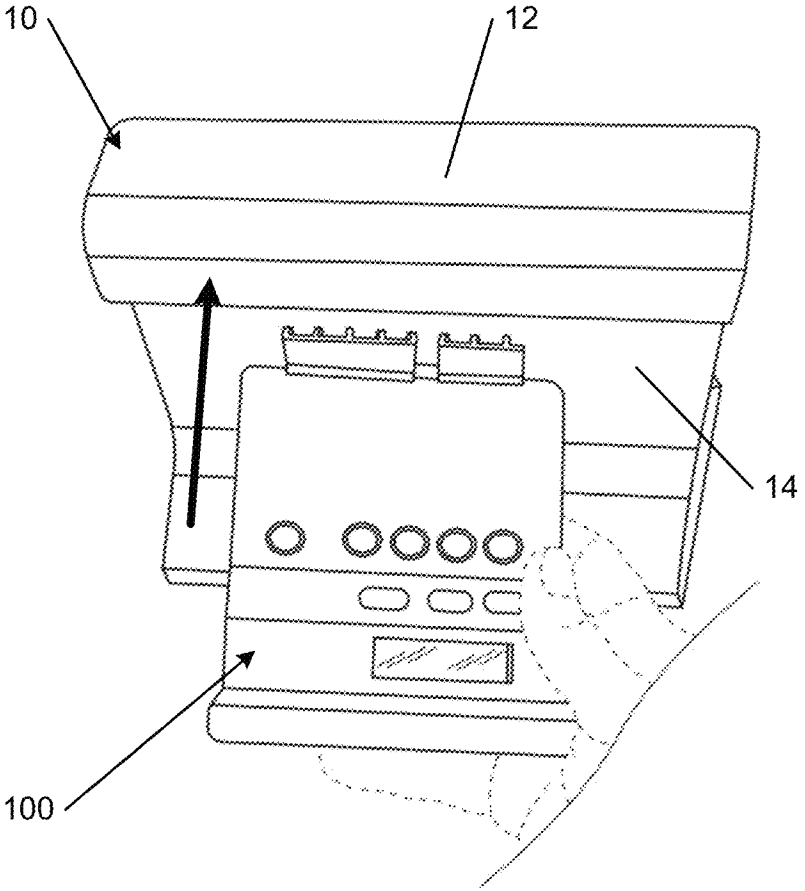
Figure 5C:
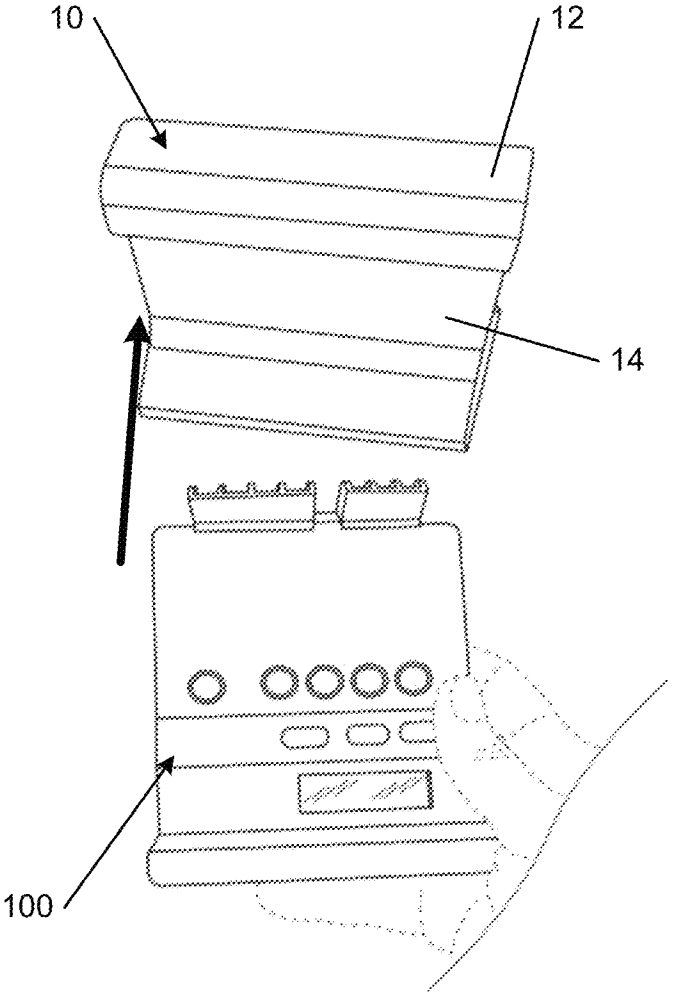

FIGS. 5C and 5D illustrate the track worker placing the derailment mitigation device 100 on the web 14 of the rail track 10 and being magnetically attached. Once the derailment mitigation device 100 is in place and magnetically attached to the rail track 10, the track worker may move approximately 50 feet or 15 meters to be safely away from all live rail tracks.

Figure 5F:
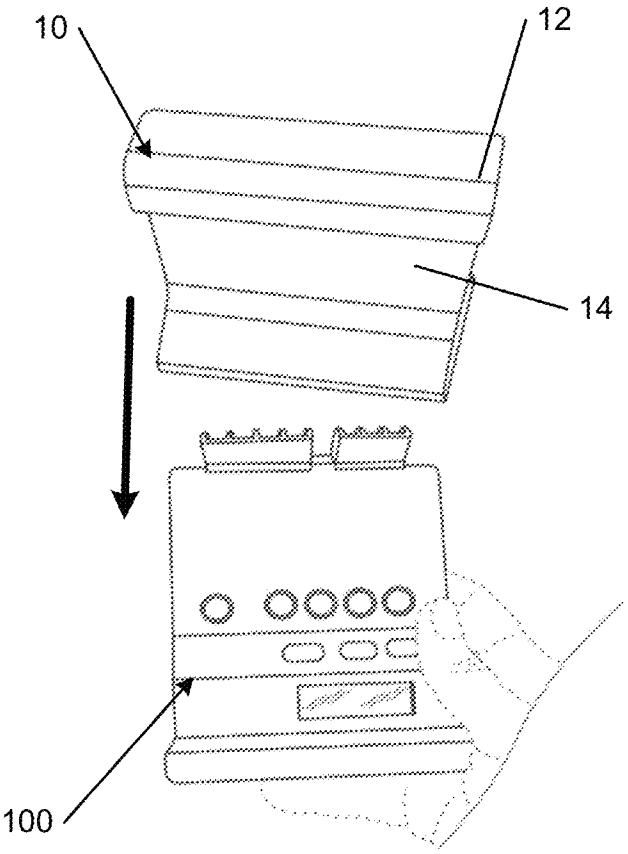
Figure 5E:
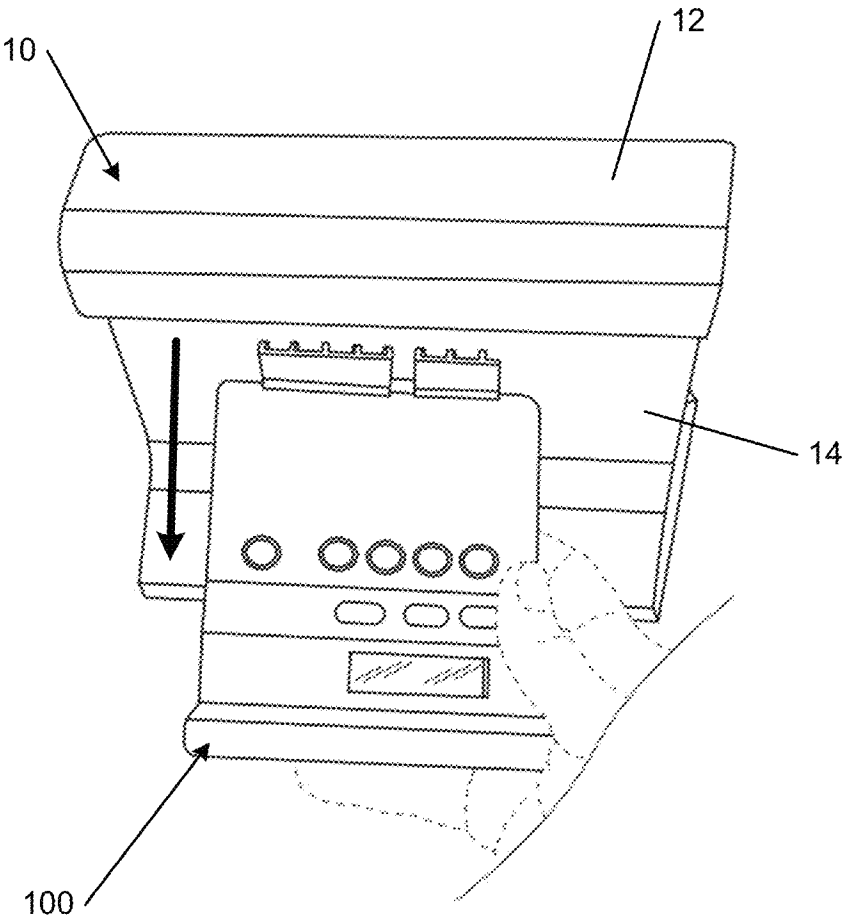

FIGS. 5E and 5F illustrate the track worker removing the derailment mitigation device 100 from the web 14 of the rail track 10. To remove the derailment mitigation device 100, the track worker may simply lift the end of the derailment mitigation device 100 to disconnect the magnets 124 and remove the derailment mitigation device 100 from the web 14 of the rail track 10 and take the derailment mitigation device 100 to a new location.

Figure 6B:
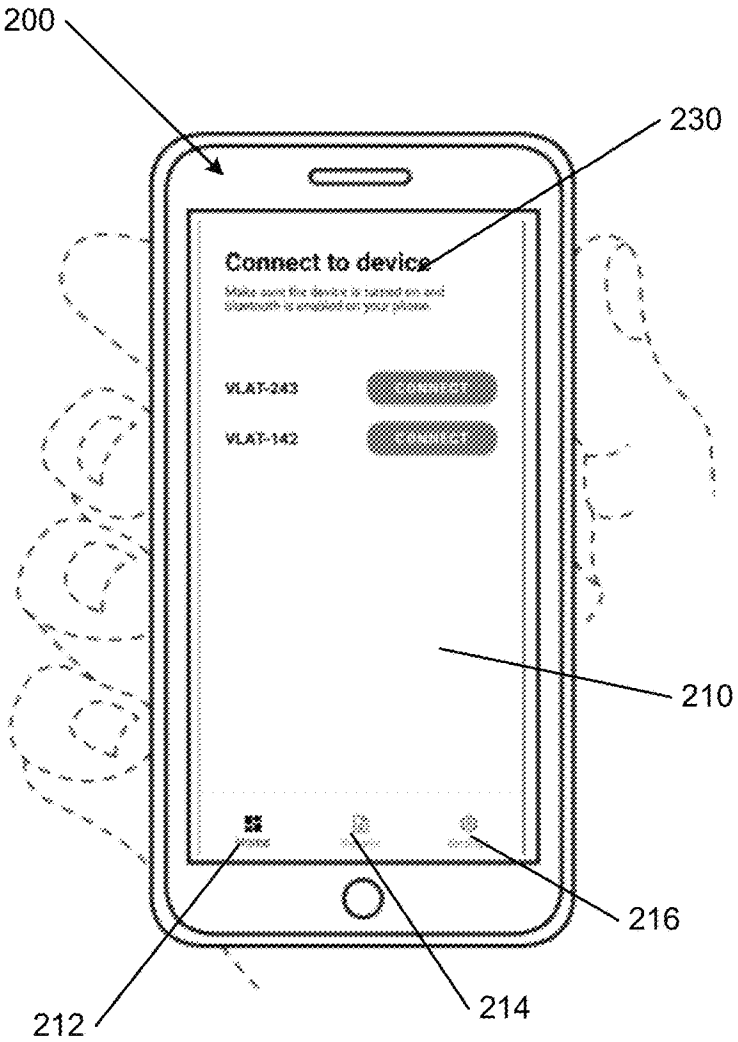
FIGS. 6A-6G depict exemplary smart device user interface screens for a connection to the derailment mitigation device from FIG. 1, according to one or more aspects described herein.
Figure 6A:
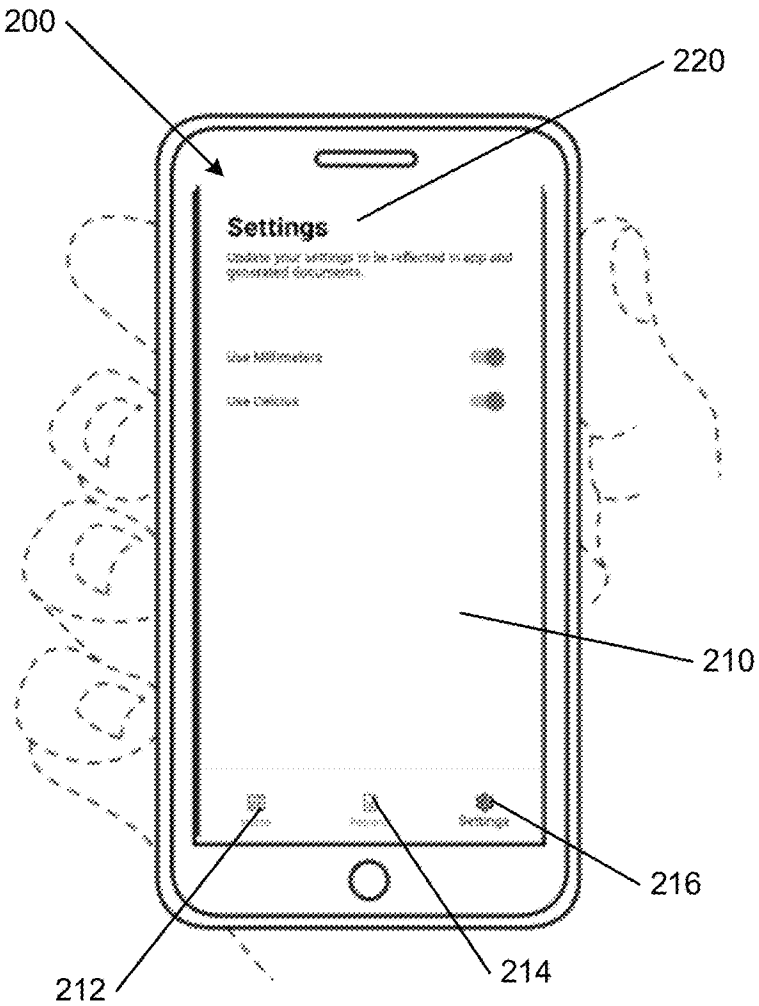
Figure 6D:
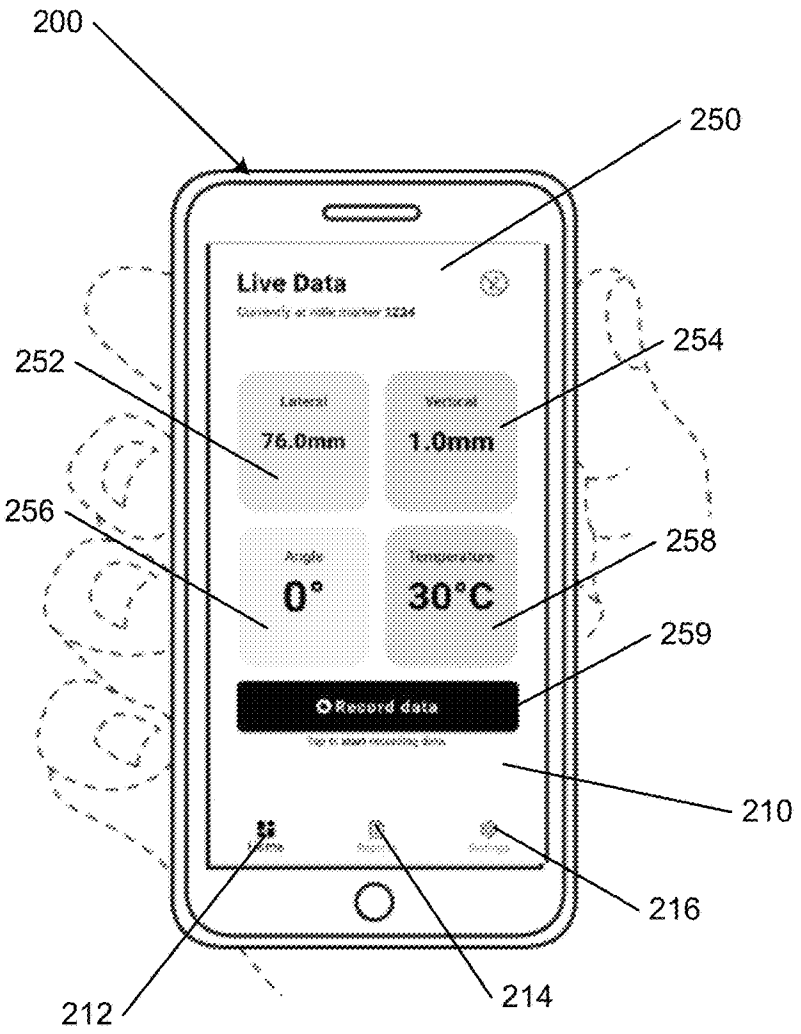
Figure 6C:
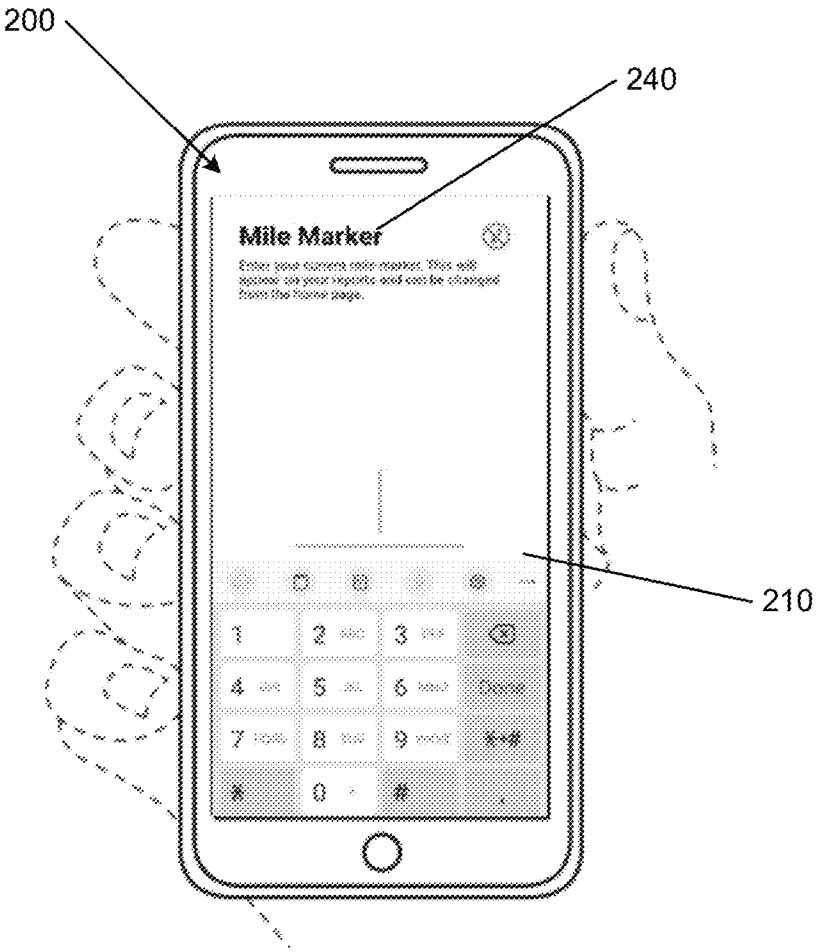
Figure 6F:
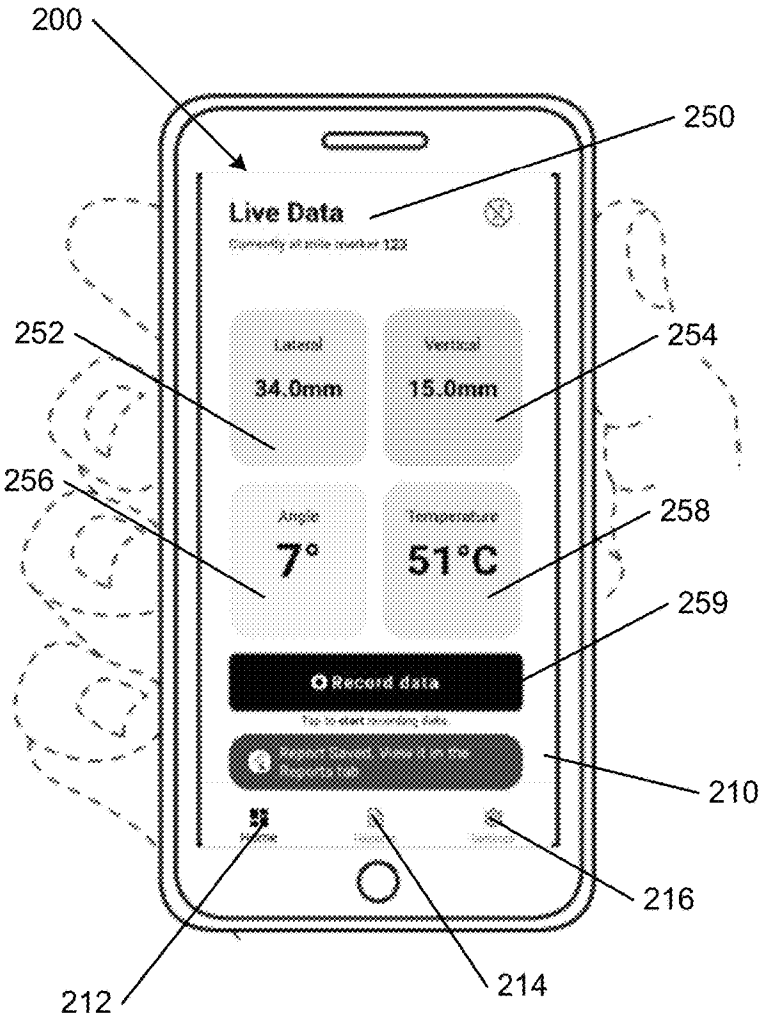
Figure 6E:
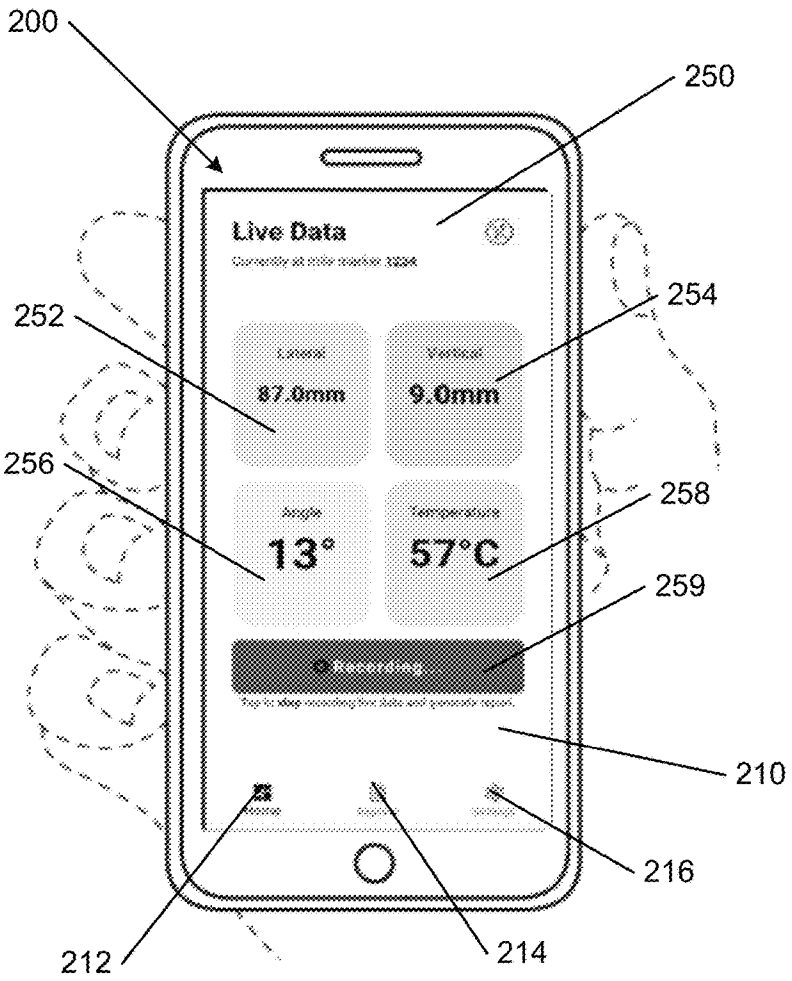
Figure 6G:
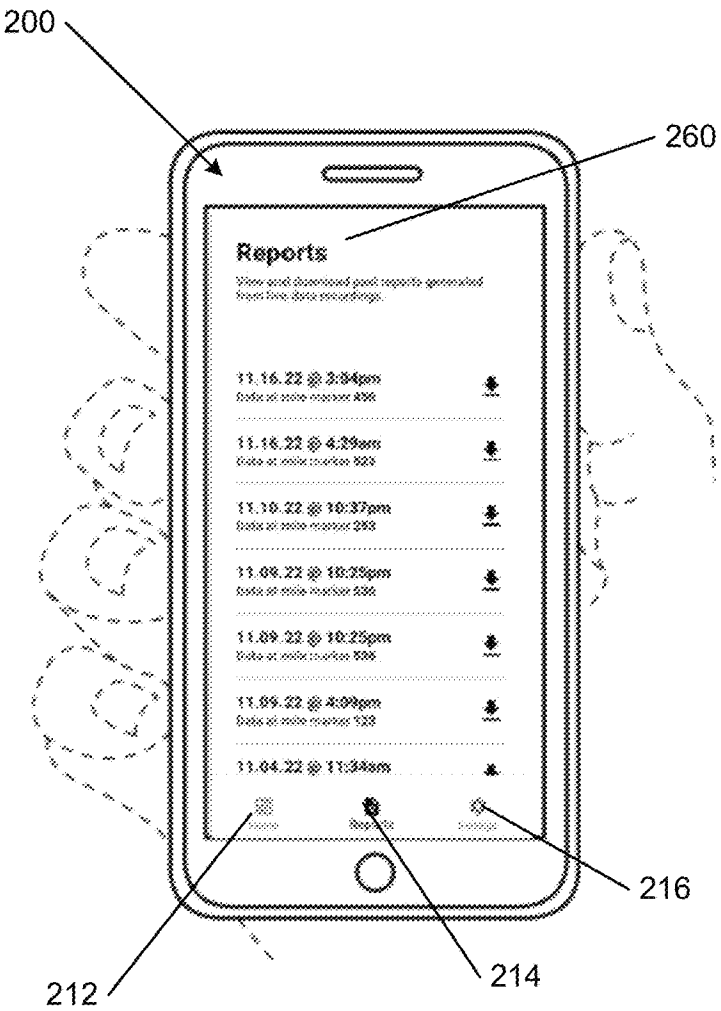

FIGS. 6A-6G illustrate exemplary smart device user interface screens 200 for an application 210 for the derailment mitigation device 100. FIG. 6A illustrates a "Settings" user interface screen 220, wherein once the user opens the application, choose "Settings" 216 at the bottom right and choose the desired settings, such as measurements (millimeters/inches/Celsius/Fahrenheit). The user will then select "Home" 212 to go to the home screen 230 as illustrated in FIG. 6B. The home screen 230 will allow the user to connect to various derailment mitigation devices 100 that are connected or have been registered. The user will select one of the shown versions of the derailment mitigation devices 100. After selecting the derailment mitigation device 100, as illustrated in FIG. 6C, the user will enter the location of the derailment mitigation device 100 on a "Mile Marker" screen 240 and press "Enter" or "Done". The location can be the current mile marker of the derailment mitigation device 100, which will appear on the reports and can be changed from the home screen. After the location is entered, as illustrated in FIG. 6D, the "Live Data" screen 250 will be displayed and the screen will be ready for you to hit "Record data" 259 when a train is approaching at full speed safely away from the tracks. The "Live Data" screen 250 may show various measurements, such as for example, "Lateral" 252, "Vertical" 254, "Angle" 256, and "Temperature" 258. The derailment mitigation device 100 can also be set-up to automatically start and record data based on the vibration sensor and the derailment mitigation device 100 sensing a train approaching the derailment mitigation device 100. As illustrated in FIG. 6E, once the user sees a train approaching, the user will select "Record data" 259 and the "Live Data" screen 250 will change to "Recording." To stop recording data, the user will select the "Recording" button 259 again to stop the recording. As illustrated in FIG. 6F, once the user selects "Recording" 259 a second time, the application will stop recording and a report will be generated automatically. As illustrated in FIG. 6G, to see a history of reports, the user will select the "Reports" button 214 at the bottom of the screen. The "Reports" screen 260 allows the user to open various historical reports and to send via email or text or other communication means.

Figure 7:
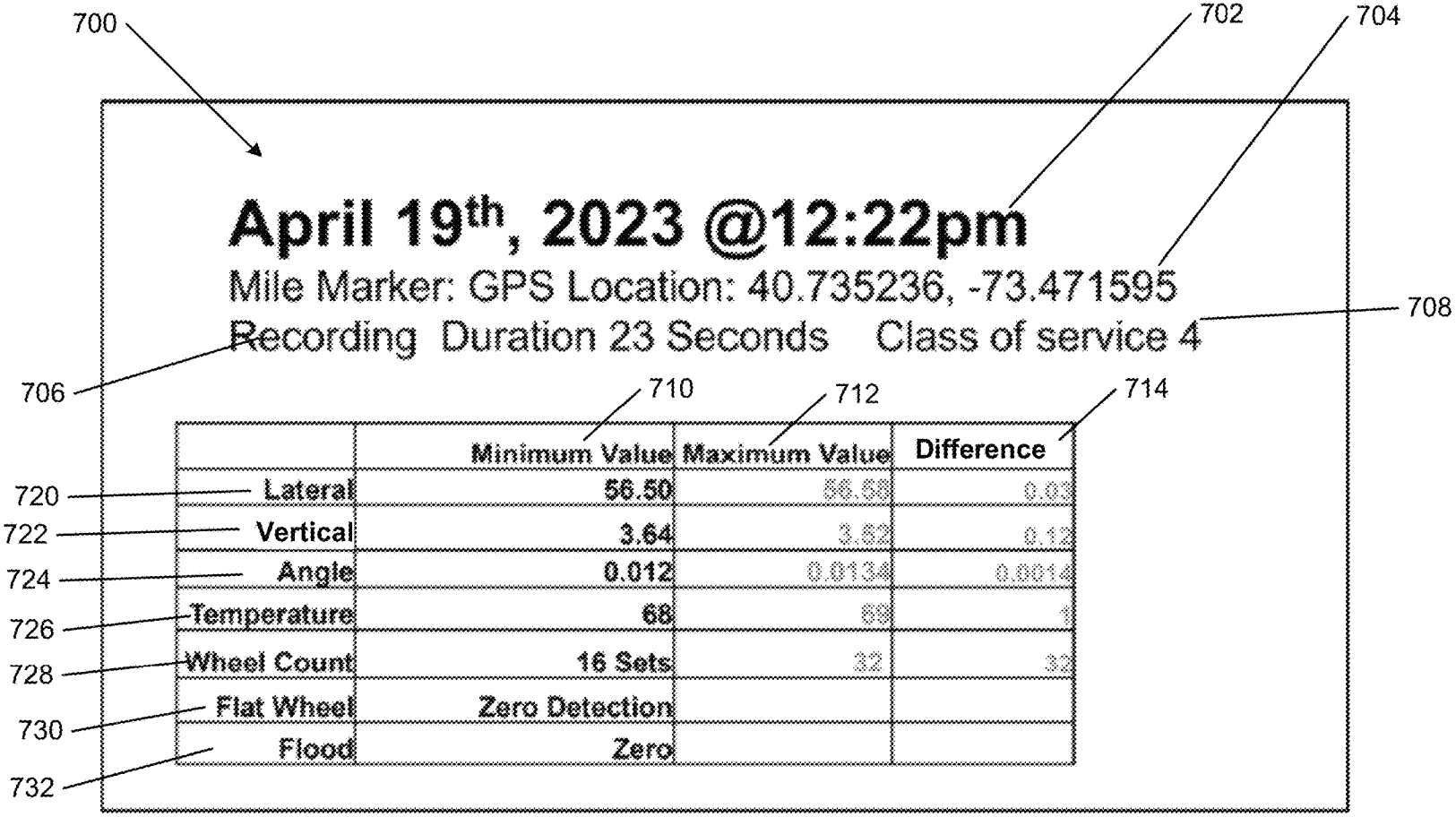
FIG. 7 depicts an exemplary report for the derailment mitigation device from FIG. 1, according to one or more aspects described herein.

FIG. 7 illustrates an exemplary report 700. The report 700 includes various information data, such as one or more of the following: date and time of data 702; location listing by mile marker and GPS location 704; recording duration time 706; class of service of the rail 708. The report 700 also includes various data from the derailment mitigation device 100, to include minimum values 710, maximum values 712, and difference between maximum and minimum 714 of various measurements, such as one or more of the following: lateral or horizontal track deflection 720, vertical track deflection 722, rail angle 724, temperature 726, wheel count 728, flat wheel detection 730, flood detection 732. The flat wheel detection 730 and the flood detection 732 may include a YES or NO type listing—such as "Zero Detection" and/or "Zero."

Figure 8A:
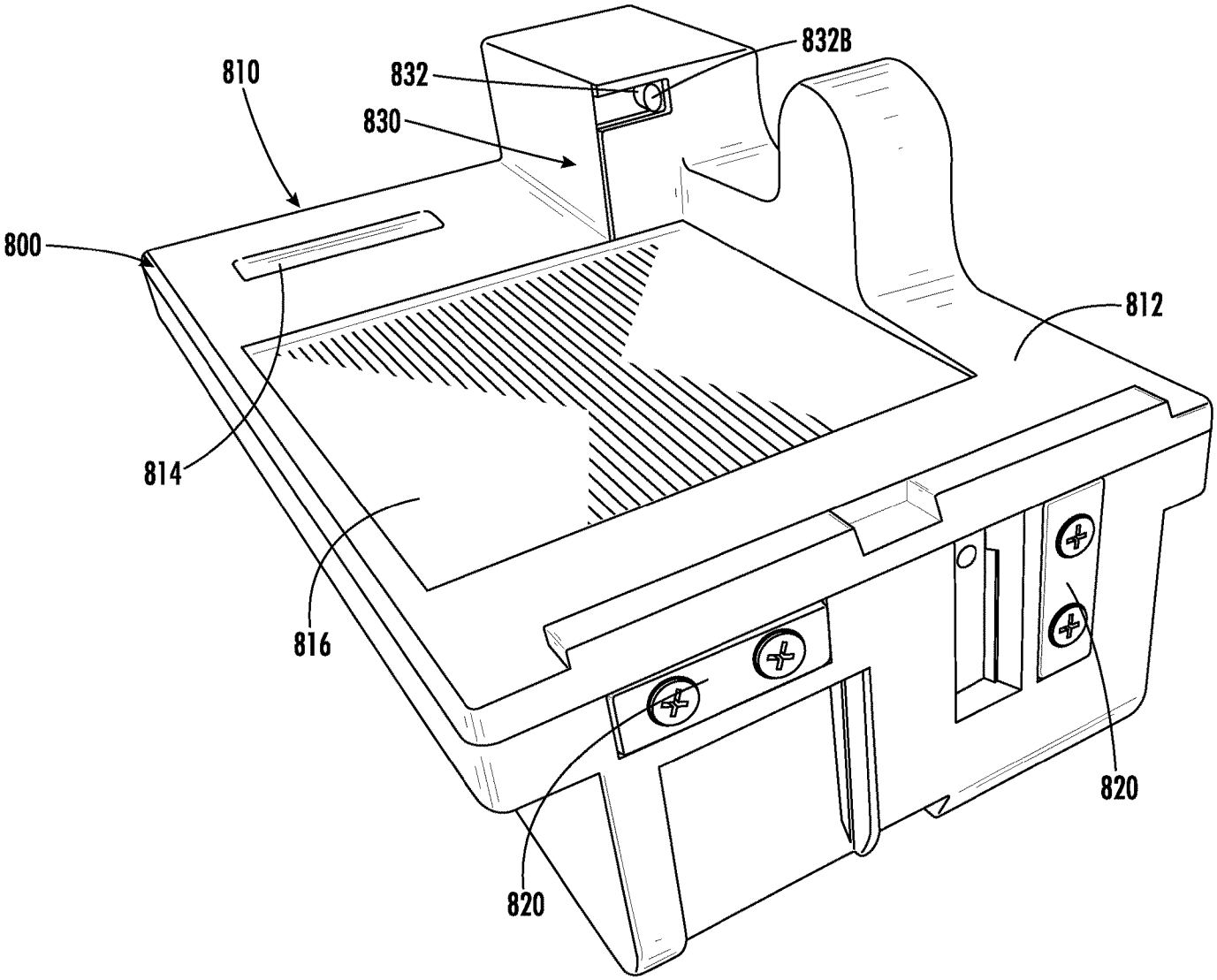
FIGS. 8A-8C depict perspective views of another derailment mitigation device, according to one or more aspects described herein.
Figure 8B:
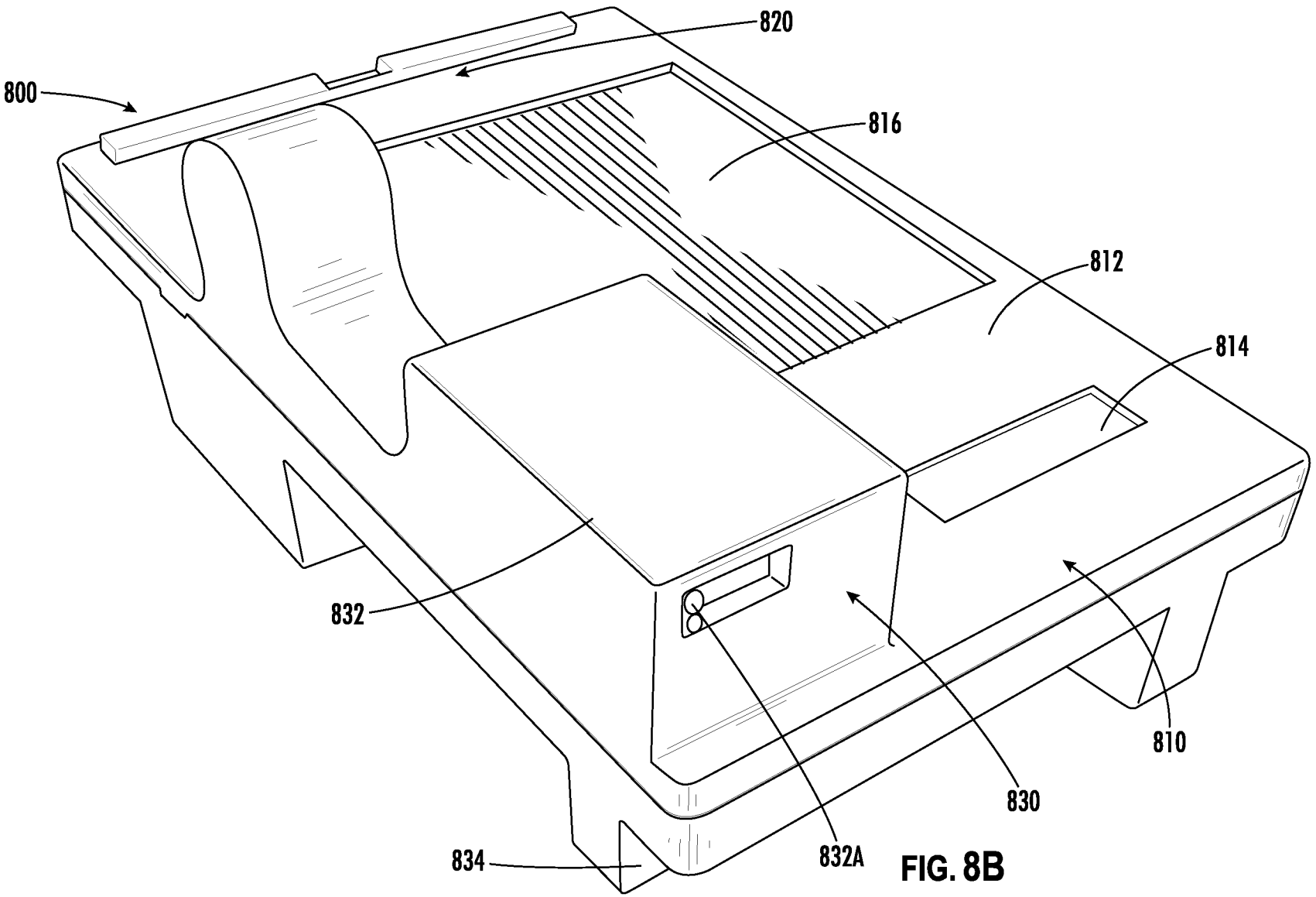
Figure 8C:
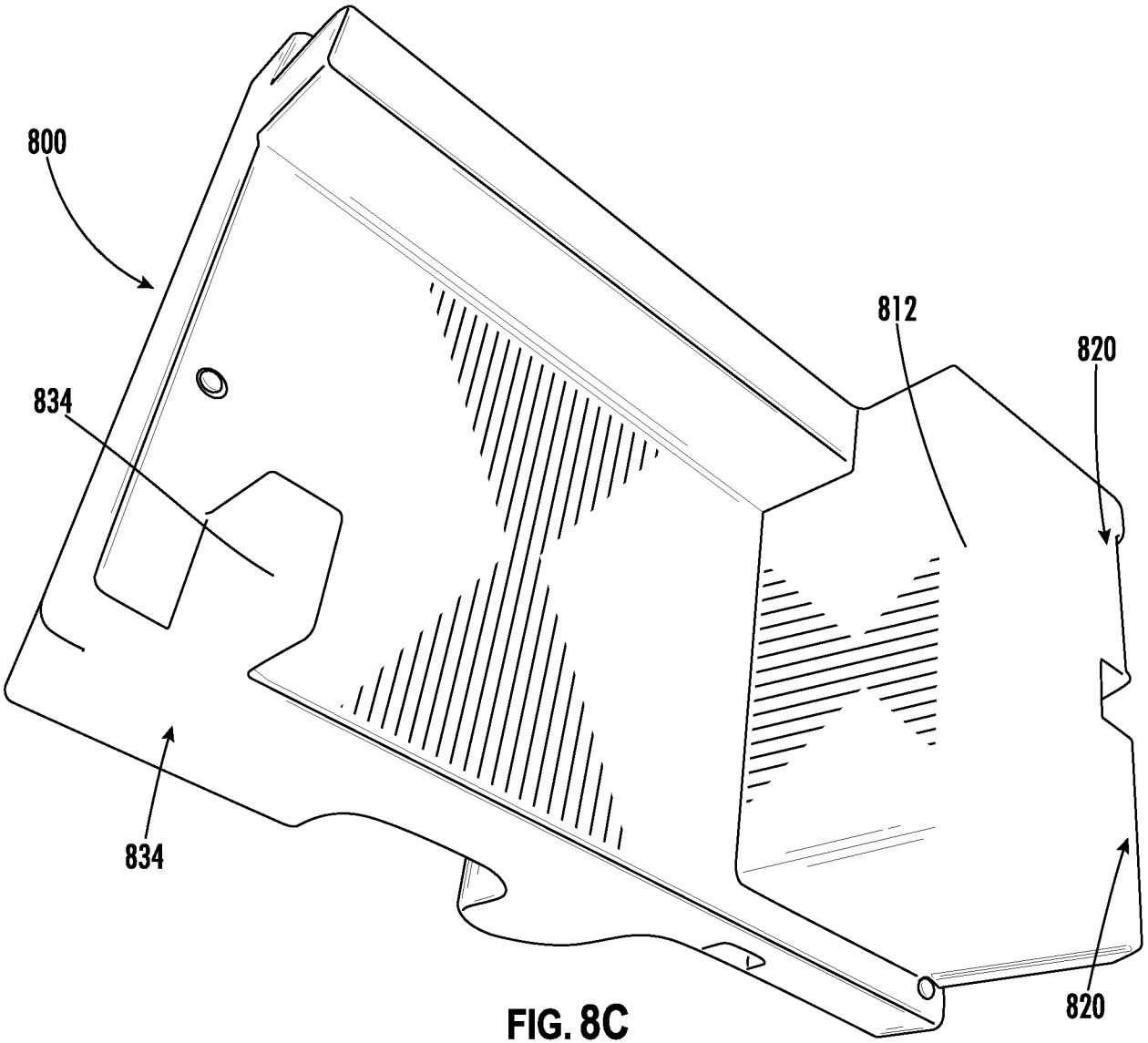

FIGS. 8A-8C illustrate another embodiment of a derailment mitigation device 800. For the embodiments regarding the derailment mitigation device 300, the features are referred to using similar reference numerals under the "8xx" series of reference numerals, rather than "1xx" used in the previous embodiments. Accordingly. certain features of the derailment mitigation device 800 that were already described above with respect to the derailment mitigation device 100 may be described in lesser detail or may not be described at all. FIG. 8A depicts a top, front perspective view of the derailment mitigation device 800. FIG. 8B depicts a top, rear perspective view of the derailment mitigation device 800. FIG. 8C depicts a bottom perspective view of the derailment mitigation device 800.

The derailment mitigation device 800 may include a base 810 with an attachment portion 820 and a laser portion 830. The attachment portion 820 may include one or more attachment mechanisms for attaching the derailment mitigation device 800 to the rail track 10, such as magnets, clips, fasteners, etc. The laser portion 830 may include one or more lasers 832, 834 to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers 832, 834 may be utilized alone or in combination with various other sensors to determine the above measurements.

The base 810 may include a control panel 812 and a display panel 814. The derailment mitigation device 800 may include a full system display 814. The control panel 812 may include buttons or switches for power and operating the derailment mitigation device 800. The control panel 812 may also include a solar panel 816 to power the derailment mitigation device 800. The control panel 812 may also house and hold one or more various other components that may be included with the derailment mitigation device 800, such as an inclinometer 170, a vibration sensor 172, a cellular/Wi-Fi controller 174, an axel sensor/counter 176, a mileage counter device 178, a GPS sensor 180, a temperature sensor 126, a tilt sensor 182, an accelerometer 184, a shock sensor 186, and/or a clock 188 (as shown in FIG. 14B). Additionally, in some embodiments, the base 810 may house one or more of the lasers as well.

The derailment mitigation device 800 may include a laser portion 830 that provides non-contact dual laser measurement with a first laser 832 and a second laser 834. The first laser 832 may be used for horizontal measurement or horizontal rail deflection to any center rail or other running rail. The first laser 832 may include a front laser 832A and a rear laser 832B used for horizontal measurement or horizontal rail deflection. The second laser 834 may be used for vertical measurement or vertical rail deflection, also known as sleeper voids. The laser portion 830 may also house and hold one or more various other components that may be included with the derailment mitigation device 800, such as the inclinometer 170, the vibration sensor 172, the cellular/Wi-Fi controller 174, the axel sensor/counter 176, the mileage counter device 178, the GPS sensor 180, the temperature sensor 126, the tilt sensor 182, the accelerometer 184, the shock sensor 186, and/or the clock 188.

Figure 9B:
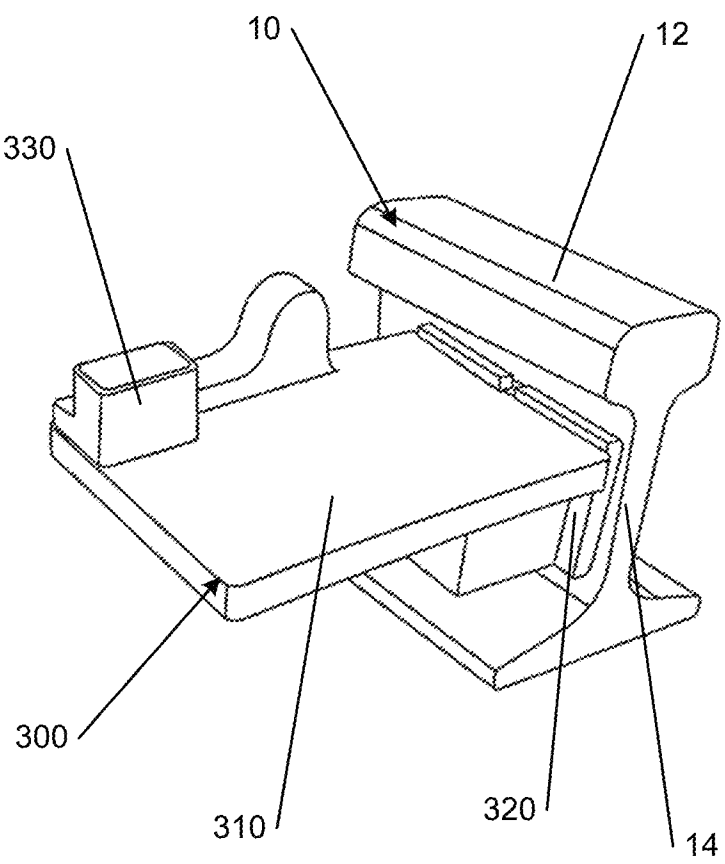
FIGS. 9A and 9B depict perspective views of another derailment mitigation device attached to a webbing on a rail track, according to one or more aspects described herein.
Figure 9A:
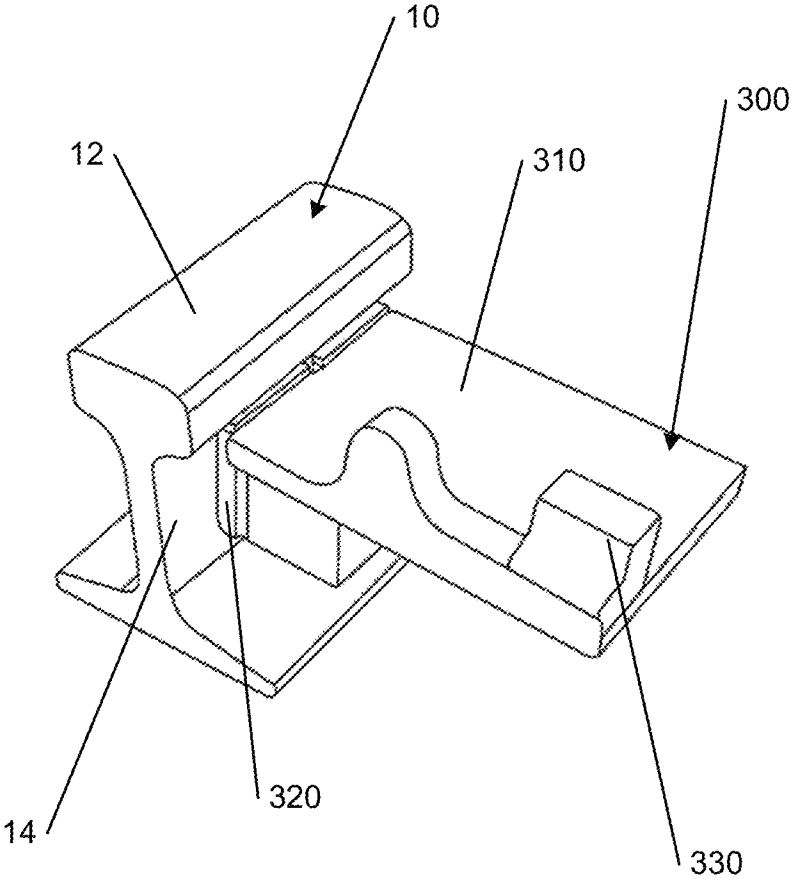

FIGS. 9A and 9B illustrate another embodiment of a derailment mitigation device 300. For the embodiments regarding the derailment mitigation device 300, the features are referred to using similar reference numerals under the "3xx" series of reference numerals, rather than "1xx" or "8xx" used in the previous embodiments. Accordingly. certain features of the derailment mitigation device 300 that were already described above with respect to the derailment mitigation device 100 and/or the derailment mitigation device 800 may be described in lesser detail or may not be described at all.

The derailment mitigation device 300 may include a base 310 with an attachment portion 320 and a laser portion 330. The attachment portion 320 may include one or more attachment mechanisms for attaching the derailment mitigation device 300 to the rail track 10, such as magnets, clips, fasteners, etc. The laser portion 330 may include one or more lasers to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers may be utilized alone or in combination with various other sensors to determine the above measurements.

Figure 10B:
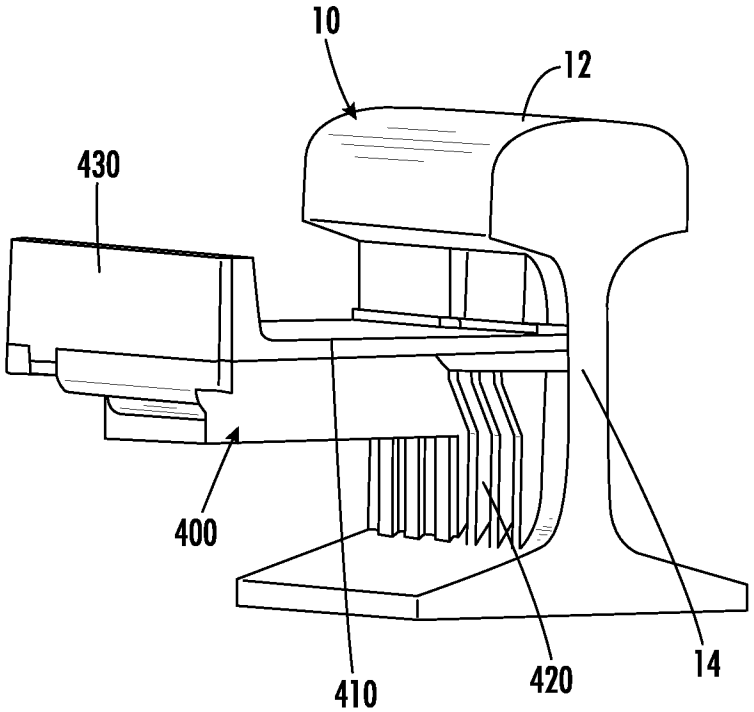
FIGS. 10A and 10B depict perspective views of another derailment mitigation device attached to a webbing on a rail track, according to one or more aspects described herein.
Figure 10A:
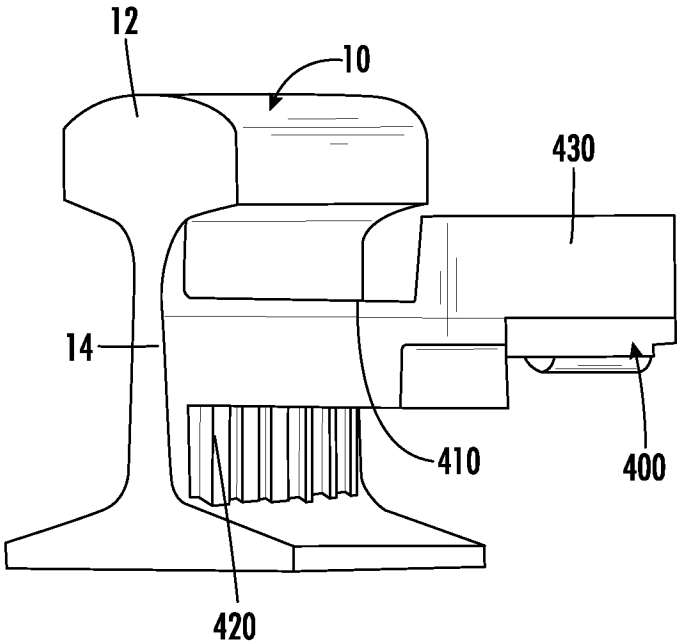

FIGS. 10A and 10B illustrate another embodiment of a derailment mitigation device 400. For the embodiments regarding the derailment mitigation device 400, the features are referred to using similar reference numerals under the "4xx" series of reference numerals, rather than "1xx", "8xx", or "3xx" used in the previous embodiments. Accordingly, certain features of the derailment mitigation device 400 that were already described above with respect to the derailment mitigation device 100, the derailment mitigation device 800, and/or the derailment mitigation device 300 may be described in lesser detail or may not be described at all.

The derailment mitigation device 400 may include a base 410 with an attachment portion 420 and a laser portion 430. The attachment portion 420 may include one or more attachment mechanisms for attaching the derailment mitigation device 400 to the rail track 10, such as magnets, clips, fasteners, etc. The laser portion 430 may include one or more lasers to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers may be utilized alone or in combination with various other sensors to determine the above measurements.

Figure 11B:
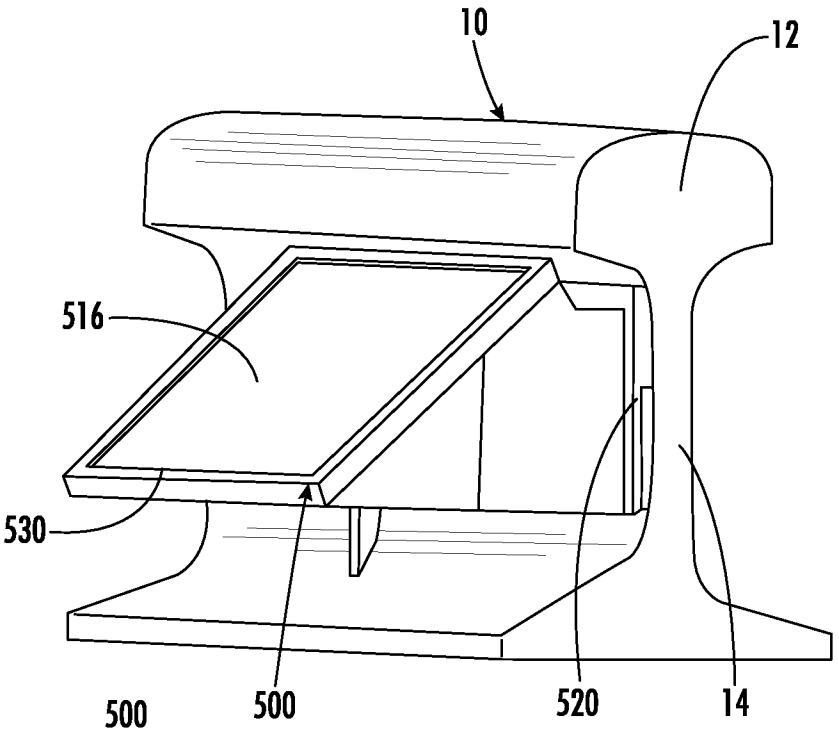
FIGS. 11A and 11B depict perspective views of another derailment mitigation device attached to a webbing on a rail track, according to one or more aspects described herein.
Figure 11A:
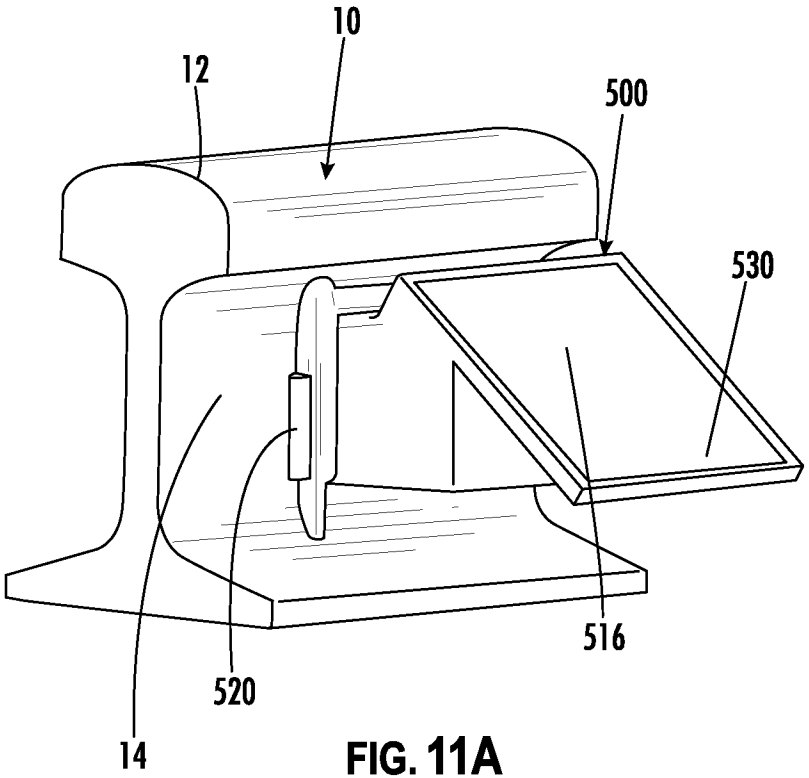

FIGS. 11A and 11B illustrate another embodiment of a derailment mitigation device 500. For the embodiments regarding the derailment mitigation device 500, the features are referred to using similar reference numerals under the "5xx" series of reference numerals, rather than "1xx", "8xx", "3xx", and/or "4xx" used in the previous embodiments. Accordingly. certain features of the derailment mitigation device 500 that were already described above with respect to the derailment mitigation device 100, the derailment mitigation device 800, the derailment mitigation device 300, or the derailment mitigation device 400 may be described in lesser detail or may not be described at all.

The derailment mitigation device 500 may include a base 510 with an attachment portion 520 and a laser portion 530. The attachment portion 520 may include one or more attachment mechanisms for attaching the derailment mitigation device 500 to the rail track 10, such as magnets, clips, fasteners, etc. The laser portion 530 may include one or more lasers to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers may be utilized alone or in combination with various other sensors to determine the above measurements. The base portion 510 may include a larger angled solar panel 516 as illustrated and shown in FIGS. 10A and 10B to help provide power to the derailment mitigation device 500.

Figure 12A:
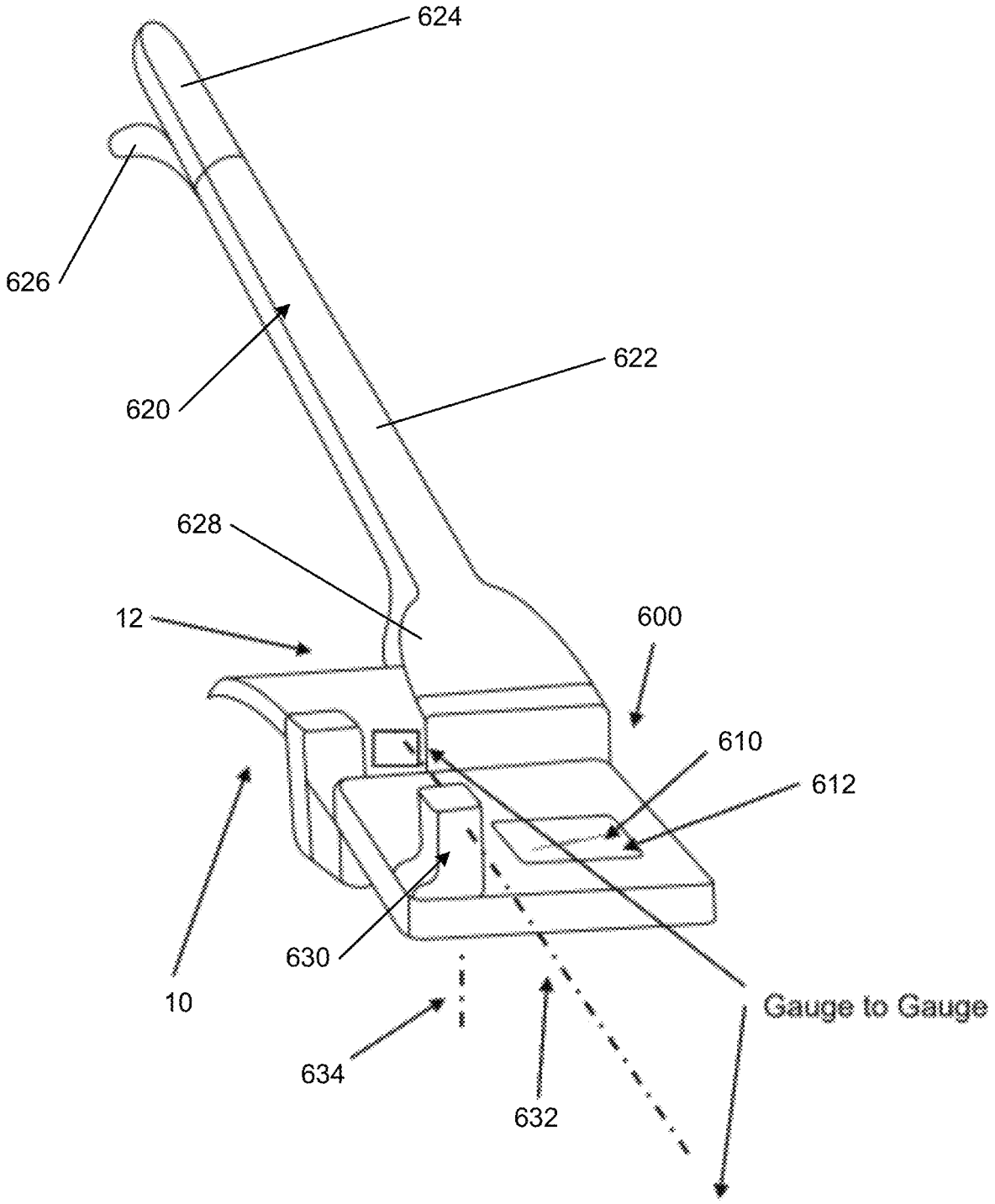
FIGS. 12A and 12B depict perspective views of another derailment mitigation device with a telescopic handle attached to a rail track, according to one or more aspects described herein.
Figure 12B:
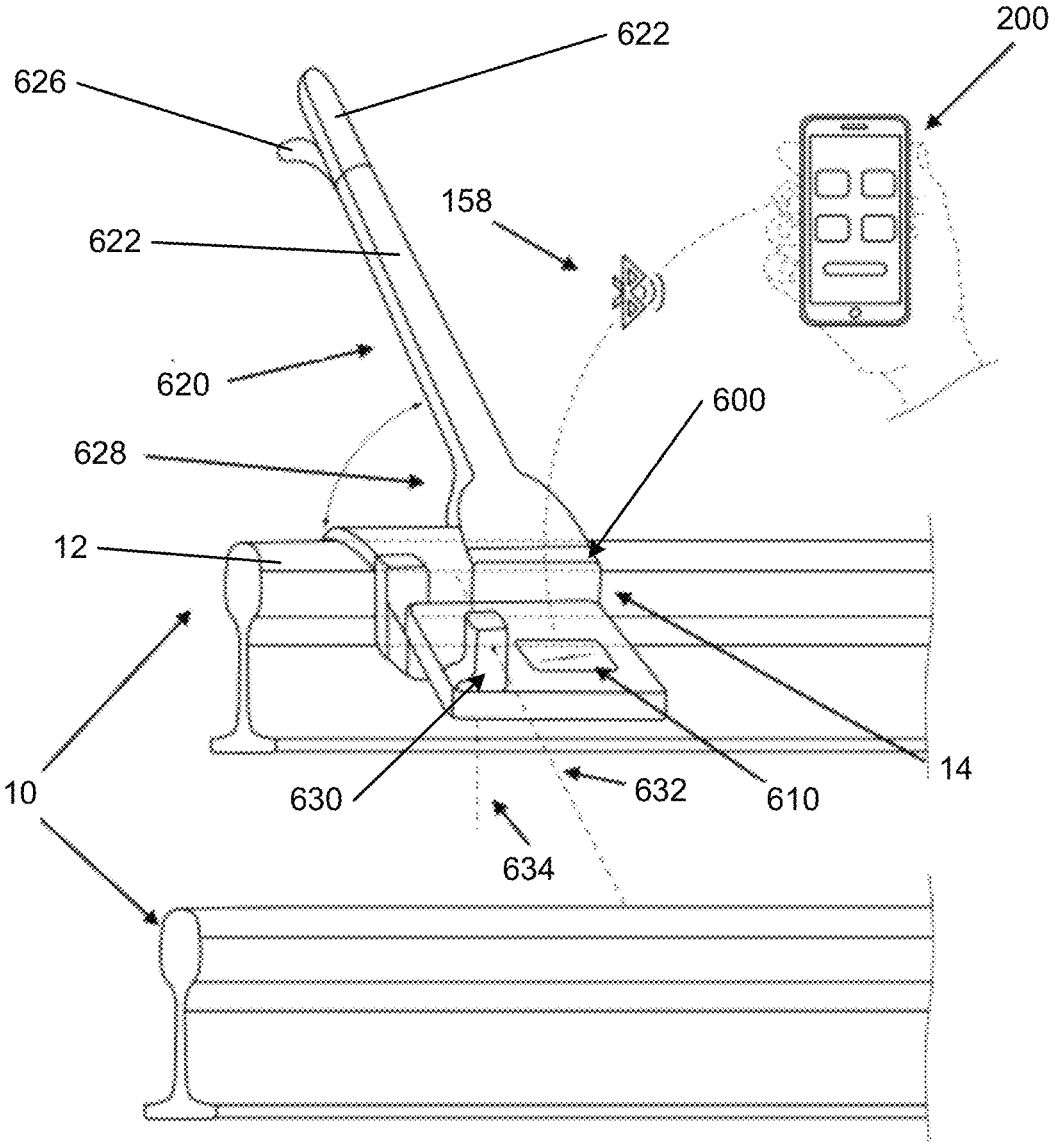

FIGS. 12A and 12B illustrate another embodiment of a derailment mitigation device 600. For the embodiments regarding the derailment mitigation device 600, the features are referred to using similar reference numerals under the "6xx" series of reference numerals, rather than "1xx", "8xx", "3xx", "4xx", and/or "5xx" used in the previous embodiments. Accordingly. certain features of the derailment mitigation device 600 that were already described above with respect to the derailment mitigation device 100, the derailment mitigation device 800, the derailment mitigation device 300, the derailment mitigation device 400, or the derailment mitigation device 500 may be described in lesser detail or may not be described at all.

The derailment mitigation device 600 may include a base 610 with an attachment portion 620 and a laser portion 630. The attachment portion 620 for the embodiment shown in FIG. 12A and 12B may include an attachment mechanism that includes a telescopic handle 622. The telescopic handle 622 may include a handle portion 624 and a lever portion 626. The telescopic handle 622 may also include a rail attachment portion 628 for attaching the derailment mitigation device 600 to the upper rail 12 of the rail track 10. The lever portion 626 may actuate up and down to lock and unlock the rail attachment portion 628 to attach and detach the upper rail 12 of the rail track 10.

By using the telescopic handle 622, the derailment mitigation device 600 may be placed portably on one of the running rails 10 to then takes the measurements needed for both running rails 10, 10A. The laser portion 630 may include one or more lasers to provide various measurements, such as horizontal/vertical rail deflection, horizontal/vertical rail distance, rail angle measurements, rail alignment, super elevation, rail wheel to rail wheel distance, wheel displacement, railway cant, rail wheel axel counter, track gage, gage face measurements, cross level measurements, twist measurements, rail/opposite checkrail measurements, flangeway clearance, switchblade opening, back-to-back check-rail measurements, underbalanced condition. The one or more lasers may be utilized alone or in combination with various other sensors to determine the above measurements.

The advantage of this derailment mitigation device 600 is that it gives a faster, safer, and more accurate way of measurement using laser and sensor technology while keeping the track worker out of the middle of the railroad tracks. With one simple step, the track inspector is off to the side of the tracks and can easily place the derailment mitigation device 600. Railway tracks require constant inspection and the measuring of gage, cross level, twist, rail/opposite checkrail, flangeway clearance, switchblade opening back-to-back check-rail and under-balanced condition where the high rail is lower than the lower rail. Currently, track inspectors use a track gage measurement tool which is a long pole like device that spans and has to touch mechanically both running rails. This prior art device has a level built-in along with a method using a dial know to increase one side or the other side of the device until the two running rails show a level area. The track inspector may then take a measuring tape and measure the level height to the top of the rail to gain how many inches or millimeters the rail on one side is super-elevated. The current method is very manual, requires the track inspect to be within the dynamic envelope of the tracks and center of the tracks and requires several measurement points to be taken. Embodiments of the derailment mitigation device 600 according to this invention eliminates these requirements.

Figure 13A:
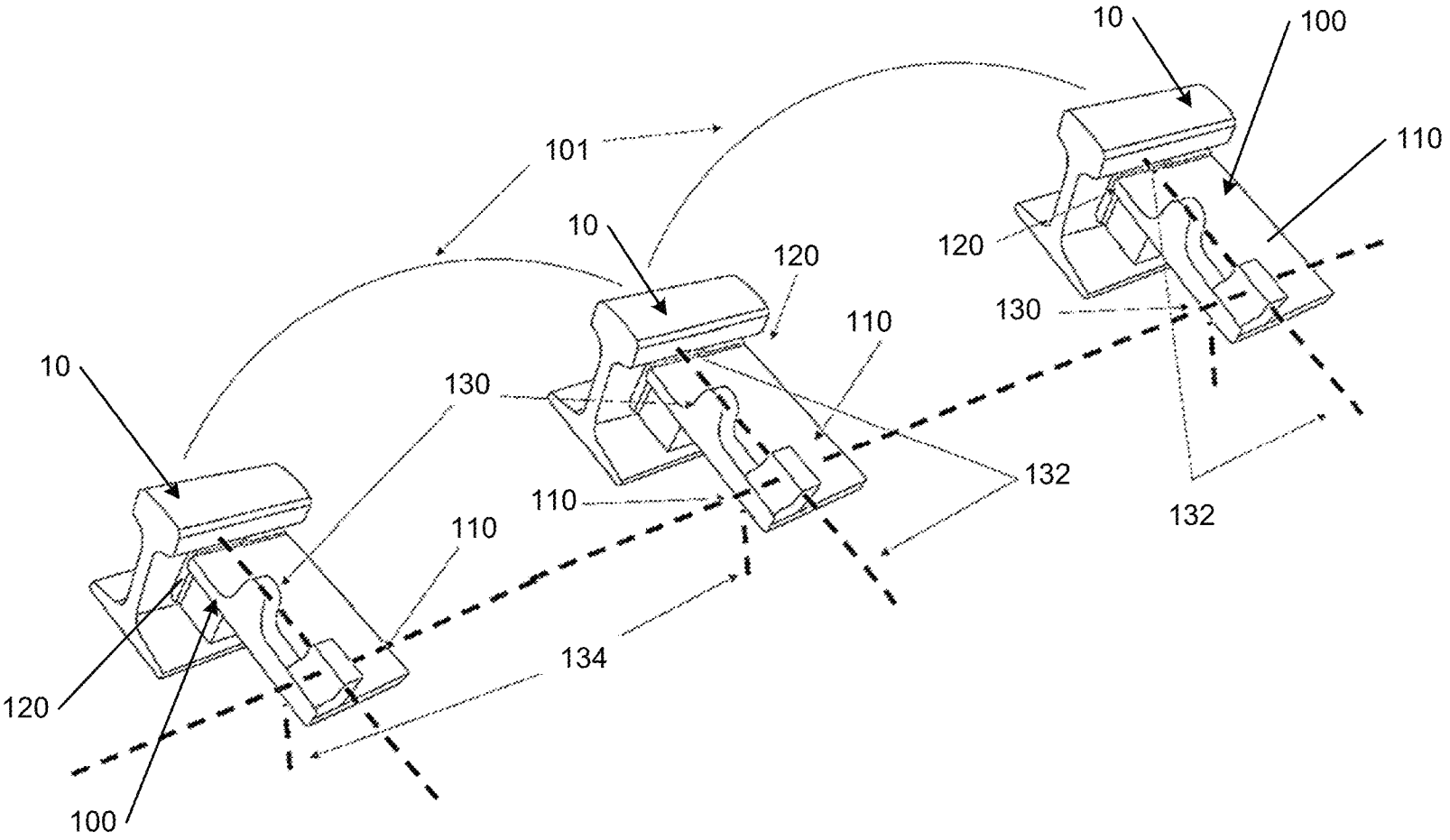
FIGS. 13A and 13B depict a mesh and daisy chain connection of a plurality of derailment mitigation devices, according to one or more aspects described herein.
Figure 13B:
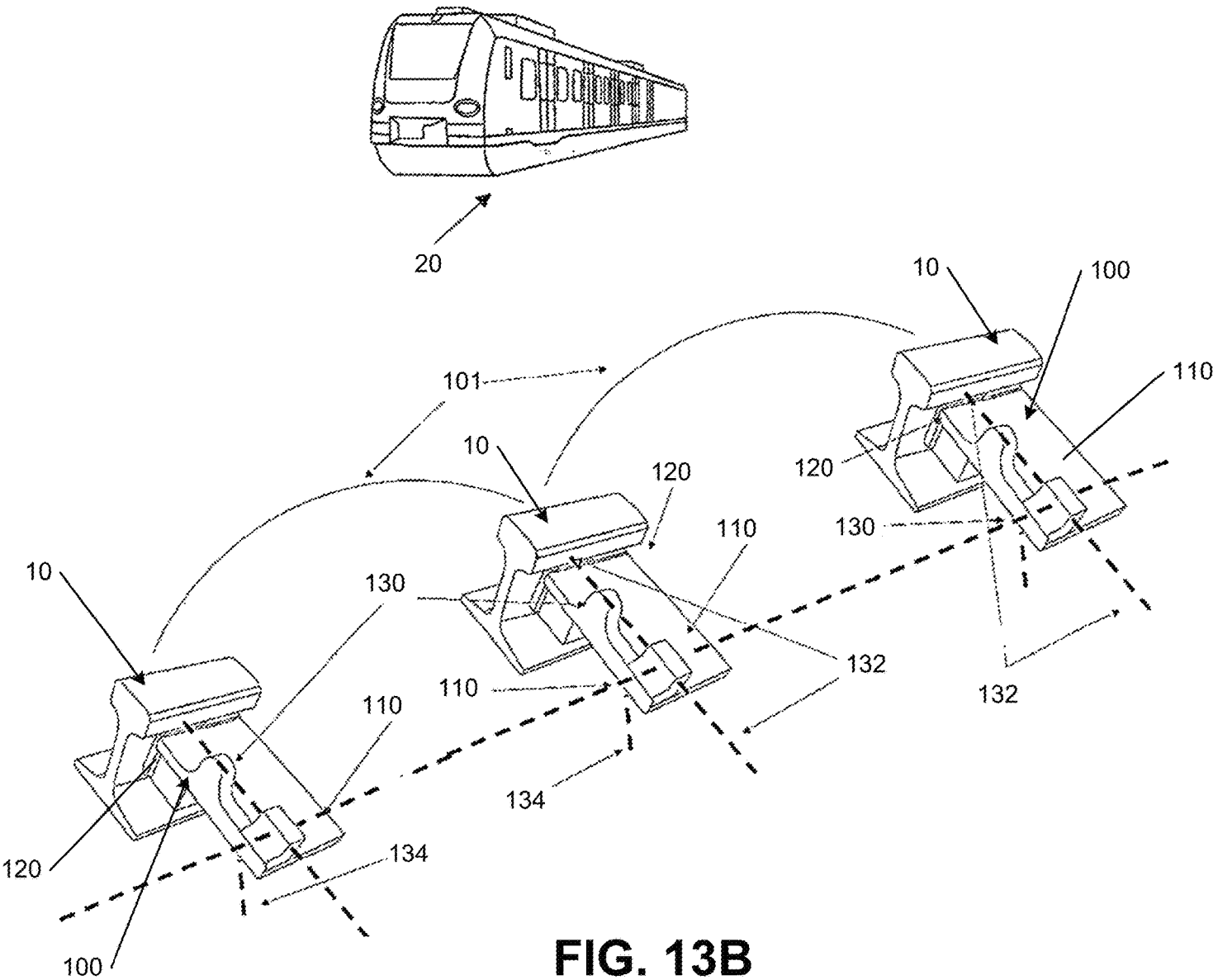

FIGS. 13A and 13B depict a mesh and daisy chain connection 101 of a plurality of derailment mitigation devices 100. The daisy chain or mesh connection 101 of the plurality of derailment mitigation devices 100 provide rail alignment and monitoring with GPS, Cellular, Wi-Fi, and/or BLE communication links 101. The rail alignment with daisy chain and/or mesh connections 101 of the plurality of derailment mitigation devices 100 with a communication link 101 from the derailment mitigation device 100 to smart phone or to a control center using BLE, Cellular, and Wi-Fi. The rail alignment with daisy chain and/or mesh connections 101 of the plurality of derailment mitigation devices 100 can also communicate with various trains 20 as illustrated in FIG. 13B.

An embodiment for a communication link and transmitting and receiving the data collected by the derailment mitigation device 100 described above is provided in FIG. 14A. The communication link from the derailment mitigation device 100 to a smart phone or control center may notify or alert when the vertical, horizontal, temperature, or angle exceed preset alarm levels. Further, the digital notifications on GPS location and alarms automatically turn on during live train and/or freight operations and automatically digitally send data to the cloud and back end to an operations control center or smart device.

The derailment mitigation device 100 may include various alerts and alarms that may be local and/or sent to smart device, control center, and/or the cloud. Below shows some exemplary alarms/alerts for the derailment mitigation device 100:

- Horizontal Alert one—in excess of plus or minus 0.5 inches
- Horizontal Alert two—in excess of plus or minus 0.75 inches
- Vertical Alert one—plus or minus 2 inches
- Vertical Alert two—plus or minus 1.75 inches and over 110 degrees temperature
- Show angle in inches or degrees and send angle measurement to smart device, control center, and/or the cloud Additionally, the derailment mitigation device 100 may include alarms, notifications, and settings pre-programmed and following applicable regulations. For example, the derailment mitigation device 100 may be pre-programmed with alarms, notifications, and settings following 49 C.F.R, Chapter 11, part 213 (49 C.F.R. § 213).

For example, the derailment mitigation device 100 may be programmed with alarms, notifications, and settings from the below chart from 49 C.F.R. § 213.55:

| Class of Track | The gage must be at least- | But not more than- |
|---|---|---|
| Excepted Track | N/A | 4'-10¼" |
| Class 1 track | 4'-8" | 4'-10" |
| Class 2 and 3 track | 4'-8" | 4'-9¾" |
| Class 4 and 5 track | 4'-8" | 4'-9½" |

In another example, the derailment mitigation device 100 may be programmed with alarms and settings from 49 C.F.R. § 213.57—Curves; elevation and speed limitations. The maximum crosslevel on the outside rail of a curve may not be more than 8 inches on track Classes 1 and 2 and 7 inches on Classes 3 through 5. Except as provided in 49 C.F.R. § 213.63, the outside rail of a curve may not be lower than the inside rail. The maximum allowable operating speed for each curve is determined by the following formula—

$$Vmax = \sqrt{\frac{Ea + 3}{0.0007\ D}}$$

Where Vmax=Maximum allowable operating speed (miles per hour)

Ea=Actual elevation of the outside rail (inches)

D=degrees of curvature (of the rail) (degrees)

For rolling stock meeting the requirements specified, the maximum operating speed for each curve may be determined by the following formula—

$$Vmax = \sqrt{\frac{Ea + 4}{0.0007\ D}}$$

Where Vmax=Maximum allowable operating speed (miles per hour)

Ea=Actual elevation of the outside rail (inches)

D=degrees of curvature (of the rail) (degrees)

In another example, the derailment mitigation device 100 may be programmed with alarms and settings from 49 C.F.R. § 213.110—Gage restraint measurement system. A track owner may elect to implement a Gage Restraint Measurement System (GRMS) supplemented by the use of a Portable Track Loading Fixture (PTLF), to determine compliance with the crosstie and fastener requirements specified in 49 C.F.R. § 213.109 and 49 C.F.R. § 213.127 provided that: 1) the track owner notifies the appropriate FRA Regional office at least 30 days prior to the designation of any line segment on which GRMS technology will be implemented; and 2) the track owner notifies the appropriate FRA Regional office at least 10 days prior to the removal of any line segment from GRMS designation.

The initial notification shall include:

1) identification of the line segments by timetable designation, milepost limits, class of track, or other identifying criteria;
2) the most recent record of million gross tons of traffic per year over the identified segment(s);
3) sufficient technical data to establish compliance with the minimum design requirements of a GRMS vehicle which specify that gage restraint shall be measured between the heads of rail:
   a) at an interval not exceeding 16 inches;
   b) under an applied vertical load of no less than 10,000 pounds per rail; and
   c) under an applied lateral load which provides for a lateral/vertical load ratio between 0.5 and 1.25, and a load severity greater than 3,000 pounds but less than 8,000 pounds;
4) Load severity is defined by the formula—

$$S=L-cV$$

where

S=load severity, defined as the lateral load applied to the fastener system (pounds);

L=actual lateral load applied (pounds);

c=coefficient of friction between rail/tie which is assigned a nominal value of 0.4;

V=actual vertical load applied (pounds); and

5) The measured gage values shall be converted to a Projected Loaded Gage 24 (PLG 24) as follows—PLG 24=UTG+A×(LTG−UTG).

The derailment mitigation device 100 may incorporate and be pre-programmed with one or all of these alarms, notifications, and settings in compliance with 49 C.F.R. § 213.

Figure 14A:
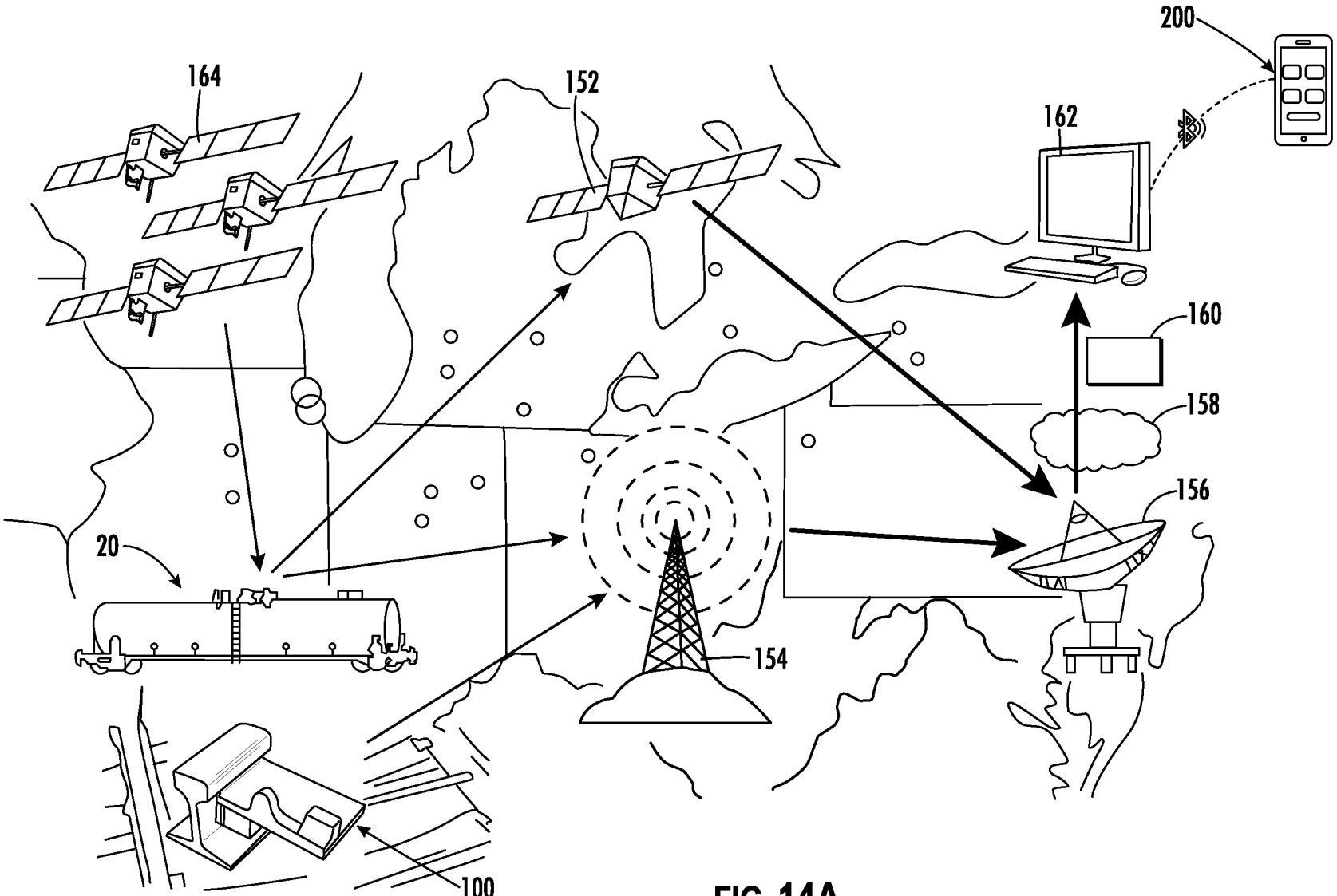
FIG. 14A depicts a diagram depicting the data transmission and reception components for the derailment mitigation device, according to one or more aspects described herein.
Figure 14B:
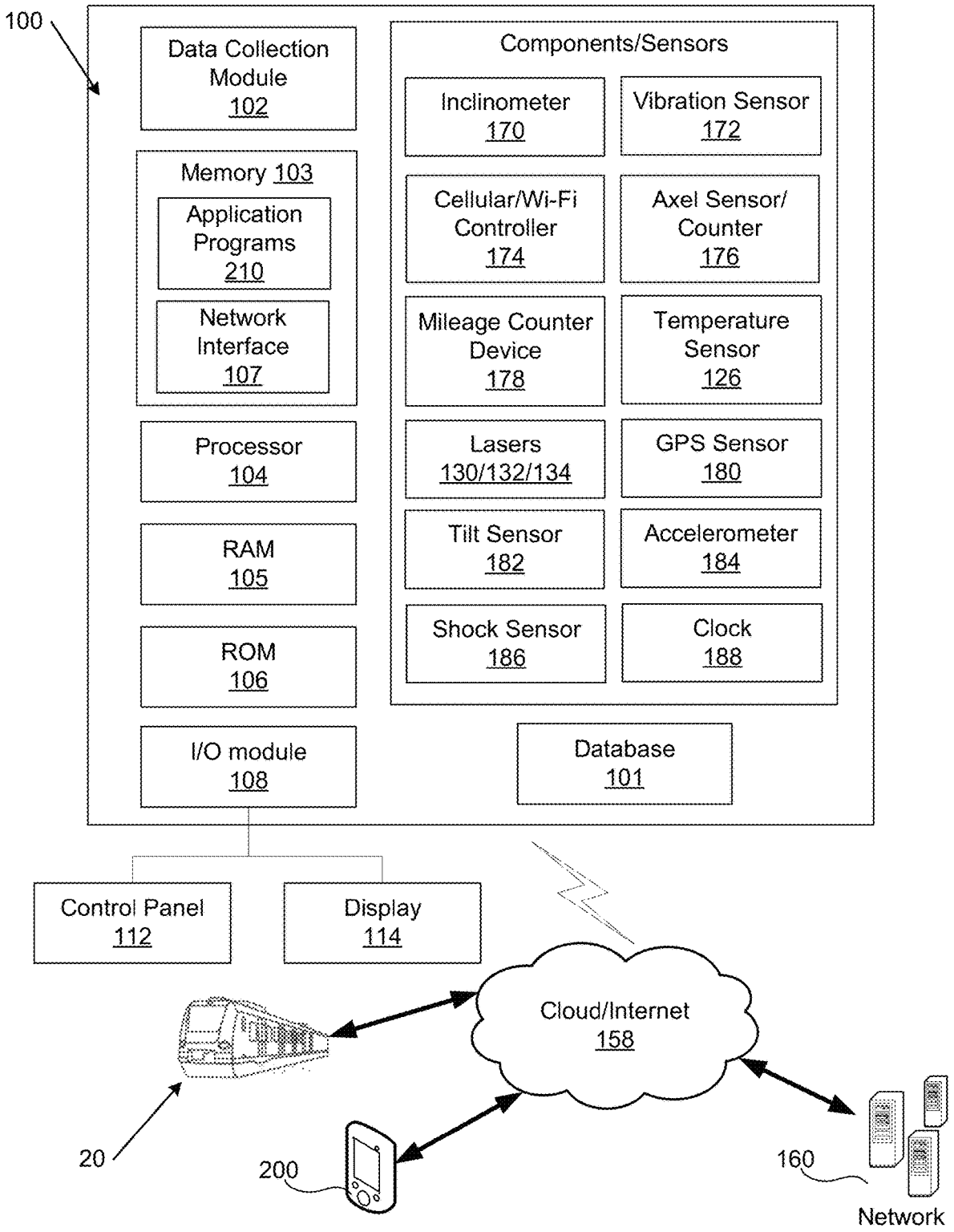
FIG. 14B depicts a block diagram illustrating the system architecture for the derailment mitigation device, according to one or more aspects described herein.

FIG. 14A illustrates one embodiment, the communication link used to connect the derailment mitigation device 100 is made using BLE, Cellular, and/or Wi-Fi, but not limited to any of the communication links mentioned. In one embodiment of the derailment mitigation device 100, the derailment mitigation device 100 may include a built-in mini solar panel for continuous power of the derailment mitigation device 100.

It should be noted that the term "remote" as used herein means any location that is not at the derailment mitigation device 100. Such a location may be next to the derailment mitigation device 100, such as in a rail yard, or a location that is cross country with respect to the location of the derailment mitigation device 100.

As illustrated in FIG. 14A, the data from the derailment mitigation device 100 may be transmitted to various devices and systems without departing from this invention. In one embodiment, the data from the derailment mitigation device 100 may be transmitted via Bluetooth to a smart device 200. Additionally, the data from the derailment mitigation device 100 may be transmitted to a geo-stationary communications satellite 152 and/or a cellular system 154 to one or more remote receiving station(s) 156. The receiving station 156 transmits the data via the Internet 158 to a web-based network or portal 160 which is accessible by a user via a workstation 162. Data collected and transmitted can be from any derailment mitigation device 100. Location data may be generated by Global Positioning System (GPS) satellite technology 164. As was described above, the derailment mitigation device 100 may feature a number of additional data collection outputs, such as angle differential, real-time rail displacement between the first rail 10 and the second rail 10A, minimum and maximum displacement between the first rail 10 and the second rail 10A, speed of the train, and direction of the train. Outputs from all of the data from the derailment mitigation device 100 may be combined together to electronically represent the status or condition.

The derailment mitigation device 100 may include a receiver/CPU and a GPS transponder which interacts with the U.S. Federal location satellites. This feature gives location, altitude, speed and other features offered by conventional GPS capabilities. The GPS and sensor data may then transmitted via a modem in the specified form of transmission along with the remaining rail displacement data. Once the data is received by the end user, the data can be further combined for additional value. A preferred method to add value to data generated by the system is by associating the location data (GPS) with information stored in the on-board memory of microprocessors in the derailment mitigation device 100.

Once data is received by the end user (such as receiving station 156 or network 160 in FIG. 14A), it is loaded into a website or computer-based software program capable of sorting, running calculations, manipulating and displaying data in formats that benefit the end user. The software may include a website which can display and run calculations to provide the needed information for the end user.

In one or more arrangements, as depicted in FIG. 14B, aspects of the derailment mitigation device 100 may be implemented with a computing device. The derailment mitigation device 100 may include or be connected to a computing device or processor 104, such as a personal computer (e.g., a desktop computer), server, laptop computer, notebook, tablet, smartphone, etc. The derailment mitigation device 100 may include a data collection module 102 for retrieving and/or analyzing data as described herein. The data collection module 102 may refer to the software and/or hardware used to implement the data collection module 102. Additionally, or alternatively, the data collection module 102 may include one or more processors 104 configured to execute computer-executable instructions, which may be stored on a storage medium, to perform the processes disclosed herein. The derailment mitigation device 100 and the data collection module 102 may include one or more sensors and/or components, such as: an inclinometer 170, a vibration sensor 172, a cellular/Wi-Fi controller 174, an axel sensor/counter 176, a mileage counter device 178, a GPS sensor 180, a temperature sensor 126, one or more lasers 130/132/134, a tilt sensor 182, an accelerometer 184, a shock sensor 186, and/or a clock 188.

In some examples, the derailment mitigation device 100 may include one or more processors 104 in addition to, or instead of, the data collection module 102. The processor(s) 104 may be configured to operate in conjunction with data collection module. Both the data collection module 102 and/or the processor(s) 104 may be capable of controlling operations of the derailment mitigation device 100 and its associated components, including RAM 105, ROM 106, an input/output (I/O) module 108, a network interface 107, memory 103, and one or more databases 101. The data collection module 102 and/or processor(s) 104 may each be configured to read/write computer-executable instructions and other values from/to the RAM 105, ROM 106, and memory 103. The one or more databases 101 may contain historical derailment mitigation data from the derailment mitigation device 100. The database 101 may contain a data storage portion that stores data and events obtained from the derailment mitigation device 100, wherein the data and the events obtained from the derailment mitigation device 100 may be stored in the data storage such as the database 101 and/or cloud storage and may be viewed from any smart device 200.

The I/O module 108 may be configured to be connected to an input device or control panel 112, such as a microphone, keypad, keyboard, touchscreen, and/or stylus through which a user of the derailment mitigation device 100 may provide input data. The I/O module 108 may also be configured to be connected to a display device 114, such as a monitor, television, touchscreen, etc., and may include a graphics card. For example, the I/O module 108 may be configured to receive biometric data from a user. The display device 114 and input device/control panel 112 are shown as separate elements from the derailment mitigation device 100; however, they may be within the same structure.

The network interface 107 may allow the derailment mitigation device 100 to connect to and communicate with a network 160. The network 160 may be any type of network, including a local area network (LAN) and/or a wide area network (WAN), such as the Internet, a cellular network, or satellite network. Through network 160, vehicle fingerprint determination device 100 may communicate with one or more other computing devices such as a user device 200 (e.g., smart device, cellular phone, laptops, notebooks, smartphones, tablets, personal computers, servers, vehicles, home management devices, home security devices, smart appliances, etc.) associated with a user of the derailment mitigation device 100. Through network 160, the derailment mitigation device 100 may communicate with one or more mobile computing train devices (e.g., devices positioned in/on a train). Through network 160, the derailment mitigation device 100 may also communicate with one or more train/transportation control center servers to exchange related information and data.

Network interface 107 may connect to the network 160 via communication lines, such as coaxial cable, fiber optic cable, etc., or wirelessly using a cellular backhaul or a wireless standard, such as IEEE 802.11, IEEE 802.15, IEEE 802.16, etc. Further, network interface 107 may use various protocols, including TCP/IP, Ethernet, File Transfer Protocol (FTP), Hypertext Transfer Protocol (HTTP), etc., to communicate with user device 200, mobile computing train devices, and train/transportation control center servers.

It will be appreciated that the network connections shown are illustrative and other means of establishing a communications link between the computers may be used. The existence of any of various network protocols such as Transmission Control Protocol/Internet Protocol ("TCP/IP"), Ethernet, File Transfer Protocol ("FTP"), Hypertext Transfer Protocol ("HTTP") and the like, and of various wireless communication technologies such as the Global System for Mobile Communications ("GSM"), Code Division Multiple Access ("CDMA"), Wi-Fi, Long-Term Evolution ("LTE"), and Worldwide Interoperability for Microwave Access ("WiMAX"), is presumed, and the various computing devices and mobile device location and configuration system components described herein may be configured to communicate using any of these network protocols or technologies.

Additionally, one or more application programs may be used by the derailment mitigation device 100 and may be embodied in computer-usable or readable data and/or computer-executable instructions, such as in one or more program modules, executed by one or more computers or other devices as described herein. Generally, program modules include routines, programs, applications, objects, components, data structures, etc. that perform particular tasks or implement particular abstract data types when executed by a processor 104 in a computer or other device. The disclosure may also be practiced in distributed computing environments where tasks are performed by remote processing devices that are linked through a communications network. In a distributed computing environment, program modules may be located in both local and remote computer storage media including memory storage devices.

Figure 15:
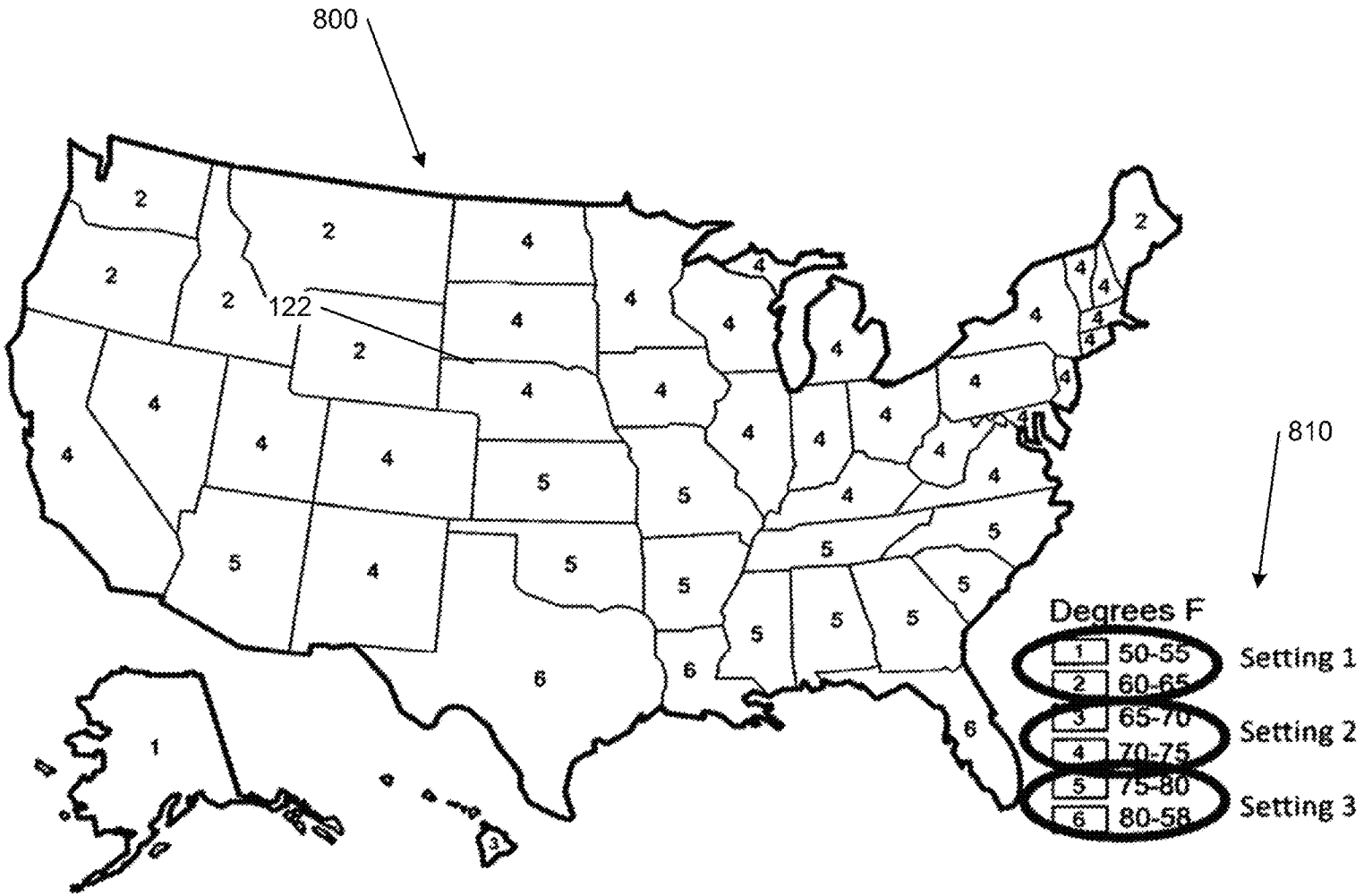
FIG. 15 depicts a diagram depicting an exemplary temperature alert and alarm system for the derailment mitigation device, according to one or more aspects described herein.

FIG. 15 shows an example of temperature alerts sent by the derailment mitigation device 100 of the preferred embodiment, based on the GPS location of the derailment mitigation device 100. Below shows an exemplary table for temperature alerts associated with FIG. 15.

| Alert | Temperature |
|---|---|
| $1^{st}$ Alert | 110 degrees F. |
| $2^{nd}$ Alert | 120 degrees F. |
| $3^{rd}$ Alert | 90 degrees F. |
| $4^{th}$ Alert | 0 degrees F. |

Three ambient temperature settings based on the National United States Ambient Temperature Chart (as depicted in FIG. 14). Setting 1-50-65 degrees, Setting 2-65-75 degrees, and Setting 3-75-85 degrees.

Monitoring temperature on a railway to prevent track kinks, buckles, or breaks is a very important requirement. Currently, a track worker/inspector walks to each line and takes a laser measurement of the rail which is highly inaccurate. Also, if the inspector or control center has any questionable temperature readings from the laser device, they slow down all revenue train services in the area which can be extremely expensive.

One of the advantages of this derailment mitigation device 100 is to prevent derailments, rail buckles, breaks, and pull aparts. The derailment mitigation device 100 will allow railways a simple way to magnetically place this device in different areas and see real-time location and rail information during live rail traffic.

Dynamic (track geometry devices) and static technology shortfalls in track inspecting systems lead to service disruptions, missed track flaws, and derailments. Embodiments of the derailment mitigation device 100 provide a complimentary device to any dynamic and static technology to assist the track inspector and mitigate service disruptions, mitigate missed track flaws, and mitigate and eliminate derailments. Embodiments of the derailment mitigation device 100 may solve many pain points and problems in the train and rail industry. For example, for dynamic systems, the following pain points and problems may be solved by the embodiments of the derailment mitigation device 100: track geometry vehicle's (TGV) or track geometry car's scheduling and expense not always real time; data must be downloaded and reviewed and must be calculated correctly; chain markers (CMs) can be off 50 feet or more, which can also be true when inspecting; CM is 100-500 feet apart, so if an operator is between two CMs, it is easy to be off 10-40 feet; some operating rules do not allow TGV runs between revenue trains so runs need to be non-revenue; additional cost to hire and maintain TGV; requires special skills to prioritize the data; and must be completed at reduced speeds. In another example, for static systems, the following pain points and problems may be solved by the embodiments of the derailment mitigation device 100: cannot watch component movement when train runs over track; must move out of the right of way (ROW) or the envelop of the train on the track where someone would be hit by the train, when a train approaches which can cause areas to be missed; if using paper forms, information can be missed when transferring to an asset management system; must carry tools to properly measure defects; need to walk in the ROW, potential for incidents; need extra employee as watchman/lookout; trains slow down when approaching inspectors, so cannot get proper pumping measurements; inspectors can't get true vertical measurements in revenue service.

Embodiments of the derailment mitigation device 100 as described above provide many key features to help mitigate service disruptions, mitigate missed track flaws, and mitigate and eliminate derailments, such as: portable and magnetically attaches to the rail and rail track; operates during full train revenue service under full speed and under full load; lasers and reads in real time vertical, lateral, angle, railway cant, temperature, and track movement; counts axels on a train passing over the device; sends data in real-time to any smart device and/or cloud; provides maximum and minimum settings for warnings and alarms; generates a full report in pdf format (or other formats) that shows the location and data from the device; allows a track inspector to be safely away from the tracks during measurements of data; and device can be left in the field for up to at least one year with one battery charge.

Additionally, the derailment mitigation device 100 may include a machine learning algorithm that may execute or operate on a rail/transportation control center/control system. The rail/transportation control center/control system may utilize a machine learning algorithm for learning trends and improving analyzing, calculating, identifying, weighting rail track and train information and values from historical determinations. The derailment mitigation device 100 and the machine learning algorithm may collect, analyze, and use initial track measurement data, historical track measurement data, periodic testing track measurement data, current track measurement data, and/or adjacent location track measurement data to learn trends for predicting maintenance, failure and derailment timing for the future. The machine learning algorithm may utilize one or more of a variety of machine learning architectures known and used in the art. These architectures can include, but are not limited to, neural networks (NN), recurrent neural networks (RNN), convolutional neural networks (CNN), transformers, and/or probabilistic neural networks (PNN), linear regression, random forest, decision trees, k-nearest neighbors, support vector machines (SVM), logistical regression, k-means clustering, association rules. RNNs can further include (but are not limited to) fully recurrent networks, Hopfield networks, Boltzmann machines, self-organizing maps, learning vector quantization, simple recurrent networks, echo state networks, long short-term memory networks, bi-directional RNNs, hierarchical RNNs, stochastic neural networks, and/or genetic scale RNNs. In a number of embodiments, a combination of machine learning architectures can be utilized, more specific machine learning architectures when available, and general machine learning architectures at other times can be used. Additionally, the machine learning algorithm may use semi-supervised learning and/or reinforcement learning.

The present disclosure is disclosed above and in the accompanying drawings with reference to a variety of examples. The purpose served by the disclosure, however, is to provide examples of the various features and concepts related to the disclosure, not to limit the scope of the invention. It is to be understood that the invention is not limited in its application to the details of construction and the arrangement of the components set forth herein. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

While the preferred embodiments of the invention have been shown and described, one skilled in the relevant art will recognize that numerous variations and modifications may be made to the examples described above without departing from the scope of the present disclosure. Thus, the spirit and scope of the invention should be construed broadly as set forth in the appended claims.

What is claimed is:

1. A portable device that is fixed onto a single rail of a rail track for measuring track deflection, comprising:

an attaching mechanism for fixing the device onto the single rail;

a plurality of lasers for measuring a vertical track deflection and a horizontal track deflection;

a temperature sensing device for measuring a temperature of an ambient temperature and a rail temperature;

a location sensing device for determining a location of the device; and a solar panel for providing continuous power to the device.

2. The device of claim 1, wherein the attaching mechanism for fixing the device is a web-mounted magnetic fixation mechanism that includes a magnet located in a magnetic reservoir within a recess on a fixing arm of the device.

3. The device of claim 2, wherein the magnet includes the temperature sensing device located opposite the magnet within the recess.

4. The device of claim 1, wherein the plurality of lasers measure a gage between the single rail and an opposite running rail of the rail track.

5. The device of claim 1 further comprising an angle sensing device for measuring an angle of the rail track, wherein the angle of the rail track is either in percentages or in inches.

6. The device of claim 1 further comprising vibration sensing device for measuring a vibration of the single rail during a train movement on the rail track, wherein when the device is in an automatic mode, the device automatically turns on when the vibration sensing device detects vibration and the device automatically turns off when the vibration sensing device detects no vibration.

7. The device of claim 1, wherein the device sends a notification and an alert when one of the vertical track deflection, the horizontal track deflection, the ambient temperature, or the rail temperature exceed preset alarm levels.

8. The device of claim 1, further including a data storage portion that stores data and events obtained from the device, wherein the data storage portion includes cloud storage that is viewed from any smart device.

9. The device of claim 1, wherein the device includes one or more of: an inclinometer, an axle sensor/counter that counts axles on a train passing over the device, or an accelerometer.

10. A portable device that is fixed onto a single rail of a rail track for measuring track deflection, comprising:

an attaching mechanism for fixing the device onto the single rail;

a plurality of lasers for measuring a vertical track deflection and a horizontal track deflection;

a vibration sensing device for measuring a vibration of the single rail during a train movement on the rail track;

a location sensing device for determining a location of the device; and a solar panel for providing continuous power to the device.

11. The device of claim 10, wherein the attaching mechanism for fixing the device is a web-mounted magnetic fixation mechanism that includes a magnet located in a magnetic reservoir within a recess on a fixing arm of the device.

12. The device of claim 10, wherein when the device is in an automatic mode, the device automatically turns on when the vibration sensing device detects vibration and the device automatically turns off when the vibration sensing device detects no vibration.

13. The device of claim 10, wherein the device sends a notification and an alert when one of the vertical track deflection or the horizontal track deflection exceed preset alarm levels.

14. The device of claim 10, wherein the device includes one or more of: an inclinometer, an axle sensor/counter that counts axles on a train passing over the device, or an accelerometer.

15. A portable derailment mitigation device that is fixed onto a single rail of a rail track for measuring track deflection, comprising:

a base that includes a control panel for controlling an operation of the portable derailment mitigation device, the base comprising:

an angle sensing device for measuring an angle of the rail track, a temperature sensing device for measuring a temperature of an ambient temperature and a rail temperature, and a location sensing device for determining a location of the portable derailment mitigation device, and an attachment portion adjacent to the base that includes one or more attachment mechanisms for fixing the portable derailment mitigation device onto the single rail; and a laser portion with a plurality of lasers that comprise:

a first laser for measuring a horizontal track deflection, and a second laser for measuring a vertical track deflection.

16. The portable derailment mitigation device of claim 15, wherein the one or more attaching mechanisms for fixing the portable derailment mitigation device is a magnetic fixation mechanism that includes one or more magnets located in a magnetic reservoir within a recess on the attachment portion.

17. The portable derailment mitigation device of claim 15, wherein the base further comprises a vibration sensing device for measuring a vibration of the single rail during a train movement on the rail track, wherein when the portable derailment mitigation device is in an automatic mode, the portable derailment mitigation device automatically starts measuring when the vibration sensing device detects vibration and the portable derailment mitigation device automatically stops measuring when the vibration sensing device detects no vibration.

18. The portable derailment mitigation device of claim 15, wherein the control panel sends a notification and an alert when one of the vertical track deflection, the horizontal track deflection, or the angle of rail exceed preset alarm levels.

19. The portable derailment mitigation device of claim 15, wherein the portable derailment mitigation device includes an axle sensor/counter that counts axles on a train passing over the portable derailment mitigation device.

20. The portable derailment mitigation device of claim 15, wherein the base includes a solar panel for continuous power.

* * * * *